US008421433B2

(12) United States Patent
Vyne

(10) Patent No.: US 8,421,433 B2
(45) Date of Patent: Apr. 16, 2013

(54) LOW NOISE BANDGAP REFERENCES

(75) Inventor: Robert L. Vyne, Gilbert, AZ (US)

(73) Assignee: Maxim Integrated Products, Inc., San Jose, CA (US)

( * ) Notice: Subject to any disclaimer, the term of this patent is extended or adjusted under 35 U.S.C. 154(b) by 443 days.

(21) Appl. No.: 12/751,737

(22) Filed: Mar. 31, 2010

(65) Prior Publication Data

US 2011/0241646 A1 Oct. 6, 2011

(51) Int. Cl.
*G05F 1/16* (2006.01)

(52) U.S. Cl.
USPC ..... 323/313; 327/339

(58) Field of Classification Search ..... 323/220, 323/222, 226, 280, 281, 311–316, 350, 907; 327/530, 535, 540–546, 539; 307/25, 82, 307/97, 38, 407, 127
See application file for complete search history.

(56) References Cited

U.S. PATENT DOCUMENTS

| | | | | | |
|---|---|---|---|---|---|
| 4,088,941 | A | * | 5/1978 | Wheatley, Jr. | 323/226 |
| 4,287,439 | A | | 9/1981 | Leuschner | |
| 4,525,663 | A | * | 6/1985 | Henry | 323/280 |
| 4,636,710 | A | | 1/1987 | Stanojevic | |
| 4,839,535 | A | | 6/1989 | Miller | |
| 5,051,686 | A | | 9/1991 | Schaffer | |
| 5,325,045 | A | | 6/1994 | Sundby | |
| 5,619,163 | A | | 4/1997 | Koo | |
| 5,834,926 | A | | 11/1998 | Kadanka | |
| 5,838,188 | A | * | 11/1998 | Taguchi | 327/530 |
| 6,052,020 | A | | 4/2000 | Doyle | |
| 6,075,407 | A | | 6/2000 | Doyle | |
| 6,242,897 | B1 | | 6/2001 | Savage et al. | |
| 6,462,526 | B1 | | 10/2002 | Tanase | |
| 6,563,370 | B2 | | 5/2003 | Coady | |
| 6,639,354 | B1 | | 10/2003 | Kojima et al. | |
| 6,765,431 | B1 | | 7/2004 | Coady | |
| 6,836,496 | B1 | | 12/2004 | Kano et al. | |
| 6,858,917 | B1 | | 2/2005 | Ranucci | |
| 6,933,770 | B1 | | 8/2005 | Ranucci | |
| 7,019,584 | B2 | * | 3/2006 | Bartel et al. | 327/539 |
| 7,088,085 | B2 | | 8/2006 | Marinca | |
| 7,242,240 | B2 | * | 7/2007 | Gierkink | 327/539 |
| 7,301,389 | B2 | | 11/2007 | Coady | |
| 7,372,318 | B2 | | 5/2008 | Scratchley et al. | |
| 7,462,884 | B2 | | 12/2008 | Sanga et al. | |
| 7,579,630 | B2 | | 8/2009 | Hashimoto | |
| 7,583,135 | B2 | | 9/2009 | Ashburn, Jr. et al. | |
| 2003/0117120 | A1 | | 6/2003 | Amazeen | |
| 2004/0041161 | A1 | | 3/2004 | Kim | |
| 2005/0001605 | A1 | | 1/2005 | Marinca | |
| 2006/0250178 | A1 | * | 11/2006 | Gierkink | 327/539 |
| 2007/0096077 | A1 | | 5/2007 | Sanga et al. | |
| 2008/0079413 | A1 | | 4/2008 | Ashburn et al. | |
| 2009/0284243 | A1 | | 11/2009 | Ashburn, Jr. et al. | |

* cited by examiner

*Primary Examiner* — Rajnikant Patel
(74) *Attorney, Agent, or Firm* — Blakely Sokoloff Taylor & Zafman LLP

(57) ABSTRACT

Low noise bandgap voltage references using a cascaded sum of bipolar transistor cross coupled loops. These loops are designed to provide the total PTAT voltage necessary for one and two bandgap voltage references. The PTAT voltage noise is the square root of the sum of the squares of the noise voltage of each transistor in the loops. The total noise of the reference can be much lower than approaches using two or 4 bipolar devices to get a PTAT voltage and then gaining this PTAT voltage to the required total PTAT voltage. The cross coupled loops also reject noise in the current that bias them. Alternate embodiments are disclosed.

16 Claims, 20 Drawing Sheets

REF
1.800V
1.250V
BG 1.230V
2.048V
R12
R13
R14
R15
R16
EN
V
OUT
EN
IB
INP
gm
amp
INM
G
30
R17
R8
R9
R10
R11
28
V
VOUT
G
IB
Trim
IN
EN
IN
BGT[7:0]
EN
A
B
C
D
E

LOW NOISE BANDGAP REFERENCES

BACKGROUND OF THE INVENTION

1. Field of the Invention

The present invention relates to the field of bandgap voltage references.

2. Prior Art

Low noise bandgap references have long been a goal of the industry and have been written about often in the technical journals.

It is well known that a bandgap reference is generated by adding two voltages together, a bipolar transistor Vbe and a delta Vbe. The Vbe has a negative TC and the delta Vbe has a positive TC. When these voltages are added together and their sum is equal to the bandgap voltage, approximately 1.2V, the TC of the sum of the voltages is close to zero.

Since the Vbe is usually close to 600 mV, this means that the delta Vbe must also be in the order of 600 mV. This 600 mV of delta Vbe is hard to generate with a single pair of transistors because it would take very big transistor ratios to do it. Most bandgap references use an amplifier to gain up these transistor ratios. For example, if you have a 10 A to A transistor emitter area ratio (60 mV) you would use an amplifier with a gain of ~10 to get to 600 mV so you could add this to a 600 mV Vbe to get to the bandgap voltage of 1.2V. This works very well, but the problem with this approach is that the noise is also gained up by 10, which in some cases is undesirable.

U.S. Pat. No. 5,834,926 to Kadanka shows that by using multiple connections of bipolar devices to multiply up the delta Vbe and then gain up the result the noise will be lower. For example, if you can connect two 10 A to A devices and then another 10 A to A device you would have 120 mV of delta Vbe and a gain of only 5 would be necessary to achieve the ~600 mV. The noise will be lower in this case. This is what is also done in the "stacked bandgap references that use about 1.2V of Vbe and 1.2V of delta Vbe to get an output voltage of ~2.4V. One of the problems here is that as you stack devices, you may run out of headroom voltage, which is not desirable for low voltage operation.

A particularly well known bandgap reference is commonly referred to as the Brokaw bandgap reference. FIG. 1 presents the circuit diagram of the basic Brokaw bandgap reference. This Figure shows the basic circuit of the reference. In this circuit, resistors R1 and R2 are equal resistors, while the emitter of transistor T1 is much larger than the emitter of transistor T2. The inputs of amplifier A are connected to resistors R1 and R2. The output of amplifier A is the reference voltage $V_{ref}$, which is also coupled to the bases transistors T1 and T2. Thus the output of the amplifier A seeks a voltage output $V_{ref}$ such that the collector voltages for transistors T1 and T2 and equal, i.e., so that the voltages across and current through the two resistors R1 and R2 are equal. However the transistors T1 and T2 are not of equal size, with transistor T1 being much larger than transistor T2, typically on the order of ten times the size of transistor T2. Thus, while the currents in the two transistors are equal, transistor T1 has a lower base emitter voltage because of its lower current density than transistor T2. Since the bases of transistors T1 and T2 are both coupled to the output voltage $V_{ref}$, the difference in their base emitter voltages appears across resistor R3. Thus the current through resistor R3 is equal to the difference in base emitter voltages between transistor T2 and transistor T1 divided by the resistance of resistor R3. Also since resistors R1 and R2 are equal, the currents through resistors R1 and R2 and transistors T1 and T2 are made equal by the feedback of the output of amplifier A, the current through resistor R4 is twice the current through resistor R3. From the Ebers-Moll model of a transistor, the difference in base emitter voltages of two transistors (pn junctions) operating at different current densities has a positive temperature coefficient, whereas the base emitter voltage (pn junction) of a single transistor has a negative temperature coefficient. Because the current through resistor R3 has a positive temperature coefficient (PIAT) and the current through transistor T2 is equal to the current through resistor R3, the voltage across resistor R4 also has a positive temperature coefficient (PIAT). Consequently, tracing from the ground connection through resistor R4 and the emitter-base voltage of transistor T2, it may be seen that the output voltage $V_{ref}$ is the sum of the PIAT voltage across resistor R4 and the negative temperature coefficient voltage (CTAT) from the emitter to the base of transistor T2. By appropriate selection of component values, the output voltage $V_{ref}$ can be made equal to the bandgap voltage of the semiconductor material (silicon) with very little temperature sensitivity or power supply sensitivity in the output voltage $V_{ref}$.

A Brokaw bandgap reference may also be realized by using transistors T1 and T2 of the same emitter area but with unequal resistors R1 and R2. Similarly, circuits are also known which use pn junction diodes as opposed to transistors and/or which use three devices, two to generate the PIAT voltage (the difference in voltage across two pn junctions operating with different current densities) and a third device for providing the negative temperature coefficient of a pn junction.

Numerous variations and improvements have been made in the basic Brokaw bandgap reference. These variations and improvements include techniques for curvature correction to reduce the remaining temperature sensitivity, to broaden the temperature range over which a given temperature sensitivity is achieved, to reduce noise and to achieve similar voltage references using field effect devices. See for instance U.S. Pat. Nos. 5,051,686, 5,619,163, 6,462,526, 6,563,370, 6,765,431 and 7,301,389, all assigned to the assignee of the present invention.

In a Brokaw bandgap reference, the difference in pn junction voltages (base-emitter voltages of transistors T1 and T2 in FIG. 1) operating at different current densities is typically on the order of one-tenth the voltage needed to add to the negative temperature coefficient pn junction voltage to provide the desired temperature insensitive bandgap voltage of approximately 1.23 volts. To be more specific, typically the difference in voltage of two pn junctions operating at different current densities is on the order of 60 millivolts (depending on the current density ratio) while the pn junction voltage is on the order of 600 millivolts. Accordingly, the difference in the pn junction voltages of the two pn junctions operating at different current densities must be voltage amplified by approximately 10 to 1, which in turn amplifies the noise generated by the two transistors. Consequently, while Brokaw type bandgap references still find wide application, there is an increasing need for bandgap references of improved performance, particularly having substantially reduced output noise.

BRIEF DESCRIPTION OF THE DRAWINGS

FIGS. 4-1 and 4-2 provide a diagram of an exemplary one bandgap voltage reference using the cascading of multiple Xpl loops as in FIG. 3.

FIGS. 6-1 through 6-3 provide a diagram of an exemplary two bandgap voltage reference using the cascading of a greater number of Xpl loops.

FIGS. 7-1 and 7-2 provide a diagram similar to that of FIGS. 4-1 and 4-2, but using active current sources instead of resistors at each Xpl loop and summing amplifier output.

FIGS. 8-1 through 8-3 provide a diagram of an exemplary two bandgap voltage reference using the cascading of a greater number of Xpl loops, but using active current sources instead of resistors at each Xpl loop output.

FIGS. 10-1 and 10-2 provide a diagram similar to that of FIGS. 4-1 and 4-2, but using two diodes (diode connected transistors) in each Xpl loop.

FIGS. 11-1 through 11-3 provide a diagram similar to that of FIGS. 6-1 through 6-3, but using two diodes (diode connected transistors) in each Xpl loop.

DETAILED DESCRIPTION OF THE PREFERRED EMBODIMENTS

Figure 2:
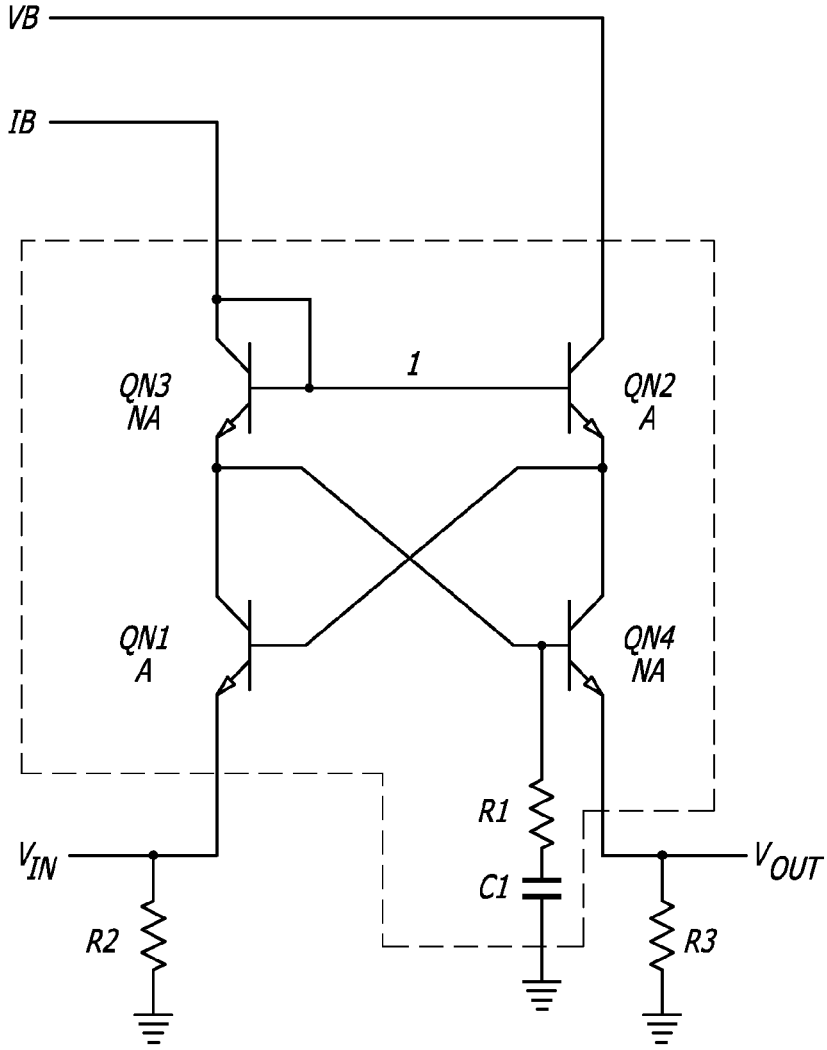
FIG. 2 is a circuit drawing for an Xpl loop used in bandgap references in accordance with the present invention.

Now referring to FIG. 2, a building block of the present invention may be seen. The circuit shown shall be referred to herein as an Xpl loop comprising four bipolar transistors of the same conductivity type, namely in this embodiment, NPN transistors QN1, QN2, QN3 and QN4. In a preferred embodiment, transistors QN1 and QN2 are matched transistors, each having an emitter area A, with transistors QN3 and QN4 also being matched transistors each having an emitter area NA, i.e., each having an emitter area that is N times the emitter area of each of transistors QN1 and QN2. In the circuit shown, a current IB is applied to the collector and base of transistor QN3, which passes through transistor QN1 and through R2. The voltage across resistor R2 is labeled VIN for reasons which will subsequently become apparent. Also a voltage VB is applied to the collector of transistor QN2, which provides current through transistors QN2 and QN4 and resistor R3. FIG. 2 shows the common connection of the emitter of transistor QN3 and the collector of QN1 is connected to the base of transistor QN4, and the common connection of the emitter of transistor QN2 and the collector of transistor QN4 is connected to the base of transistor QN1.

With the connections shown in FIG. 2, starting at voltage VIN, the voltage of node 1 is equal to the voltage VIN plus the base emitter voltage of transistor QN1 plus the base emitter voltage of transistor QN2, with the voltage VOUT being equal to the voltage at node 1 minus the base emitter voltage of transistor QN3 minus the base emitter voltage of transistor QN4. Thus in equation form, the output voltage VOUT can be written as follows:

$$VOUT=VIN+VBE_{QN1}+VBE_{QN2}-VBE_{QN3}-VBE_{QN4}$$

This may be rearranged as follows:

$$VOUT=VIN+(VBE_{QN1}-VBE_{QN3})+(VBE_{QN2}-VBE_{QN4})$$

$$VOUT=VIN+2\Delta VBE$$

Assuming for the moment that the base currents in the four transistors QN1-QN4 are relatively negligible, the voltage term $VBE_{QN1}$-$VBE_{QN3}$ represents the difference in base emitter voltages (ΔVBE) between two transistors operating with the same collector current (IB), but with different current densities because of their different emitter areas. Similarly, the voltage term $VBE_{QN2}$-$VBE_{QN4}$ also represents the difference in base emitter voltages (ΔVBE) between two transistors operating with the same collector current, but with different current densities because of their different emitter areas. Assuming the emitter area ratio N is the same for transistors QN2 and QN4 and for transistors QN1 and QN3, VOUT can be expressed as:

$$VOUT=VIN+(2kT/Q)\ln(N)$$

where:

T=absolute temperature k=Boltzmann constant

Q=the electrical charge on an electron

Thus each of these ΔVBE voltages is a PTAT voltage suitable for use as a PIAT voltage in a bandgap reference.

Figure 3:
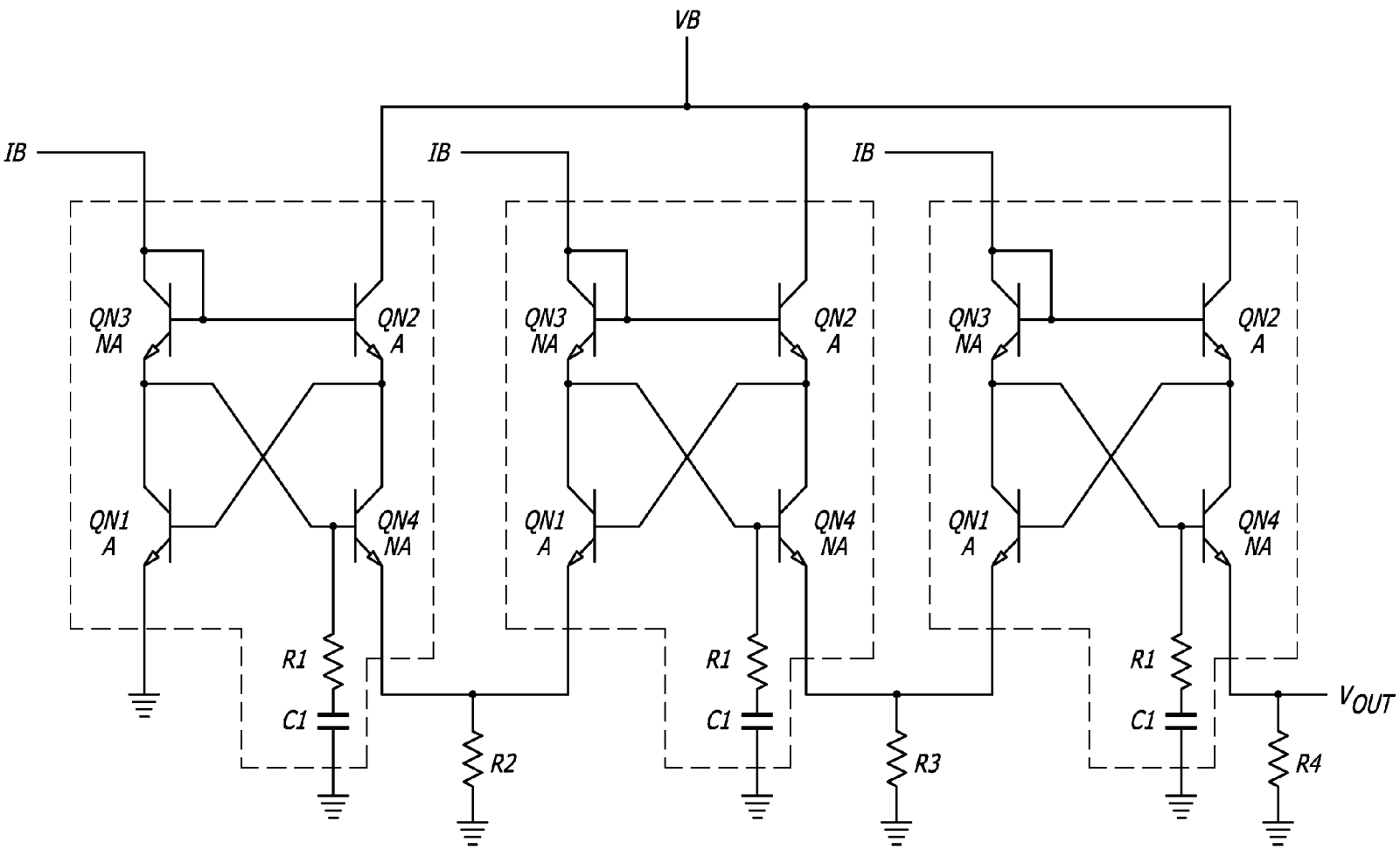
FIG. 3 illustrates a cascading of multiple Xpl loops, each in accordance with FIG. 2.

In particular, assume for the moment that R2 is zero so that VIN is at ground potential. The voltage VOUT will be a PTAT voltage 2ΔVBE increments above ground potential. The circuit of FIG. 2 may be cascaded with additional Xpl PTAT voltage circuits, also in accordance with FIG. 2, as shown in FIG. 3. As shown therein, the output VOUT (FIG. 2) for the first Xpl loop forms what will be the input voltage VIN for the second Xpl loop, with the 2ΔVBE voltage generated by the second Xpl loop being added to the 2ΔVBE PTAT voltage generated by the first Xpl circuit. Thus in the circuit of FIG. 3, the output voltage of the first Xpl loop will be equal to the PTAT voltage 2ΔVBE. The current through R2, namely the desired current through transistors QN2 and QN4 of the first Xpl loop plus the bias current IB through the transistors QN3 and QN1 of the second Xpl loop, will be equal to the PTAT voltage 2ΔVBE divided by the resistance of resistor R2. Thus resistor R2 acts as a current source equal to 2ΔVBE/R2, and resistors R3 and R4, and corresponding resistors in other embodiments described herein, act as current sources, and may be replaced by active current sources if desired. Similarly, current is pulled from the voltage source VB, in that the current supplied by each connection to VB is the current required to provide the PTAT voltage drop across the respective resistor (or current for the current source used in place of the respective resistor) connected to the respective emitter of transistor QN4. In that regard, in the preferred embodiment, all Xpl loops have the same bias current, with the currents through transistors QN2 and QN4 equal to the currents through transistors QN3 and QN1, in a preferred embodiment both currents being on the order of 4 microamps.

Note that any noise on the voltage VB or in the bias current IB does not substantially change the PTAT voltages generated or their temperature sensitivity, as the PTAT voltages are only sensitive to the difference in current densities in the two series connected pairs of transistors, and is essentially independent of the magnitude of the current (IB) itself. These small current variations have little effect on the cumulative PTAT voltage VOUT that is obtained by cascading Xpl loops as shown in FIG. 3. Thus the PTAT voltage VOUT of FIG. 3 is substantially immune to noise in the bias currents IB of the cascaded Xpl loops due to the cross coupled nature of each Xpl loop. Consequently, substantially the only noise on the output voltages VOUT is the noise generated within the four transistor Xpl circuits themselves. Since this noise is not correlated between Xpl loops, the output noise VOUT of the final Xpl loop in a cascaded series of Xpl circuits is equal to the square root of the sum of the squares of the noise in each Xpl loop, not the noise of one Xpl loop times the number of Xpl loops cascaded. Thus not only is each Xpl loop substantially immune to the bias current noise, but the noise in one Xpl loop does not linearly add like the PTAT ΔVBE voltage itself does when multiple loops are cascaded.

Now referring to FIG. 3 again, three cascaded Xpl loops are shown. In the first loop, the emitter of transistor QN1 is connected to ground so that the emitter of transistor QN4 will be at a voltage of 2ΔVBE above ground. Since this voltage is essentially clamped by the first Xpl loop, the value of resistor R2 will determine the current through transistors QN2 and QN4. In particular, assuming the same currents are desired through transistors QN2 and QN4 as through transistors QN3 and QN1 so that each Xpl loop is to have the same current bias, resistor R2 would be selected to conduct twice that current bias, i.e. the current through transistors QN2 and QN4 of the first Xpl loop plus the current though transistors QN3 and QN1 of the second Xpl loop (2IB), with a voltage across resistor R2 of 2ΔVBE. The same considerations apply to determining the value of resistor R3, although that resistor will nominally be twice the value of resistor R2, as the voltage on the emitter of transistor QN4 will be 4ΔVBE, i.e., twice the voltage on the emitter of transistor QN4 in the first Xpl loop. Similarly, VOUT will be 6ΔVBE, with resistor R4 being selected to conduct a bias current approximately equal to IB, plus whatever current is required by the circuit connected to VOUT. Thus there is a progression in resistor values tending to equalize the currents through transistors QN2 and QN4 of all Xpl loops. In these Xpl loops, the R1, C1 circuits are optional. Again, since the 2ΔVBE (at R2), 4ΔVBE (at R4) and 6ΔVBE (at R5) voltages are PTAT voltages and thus vary with temperature.

Figure 1:
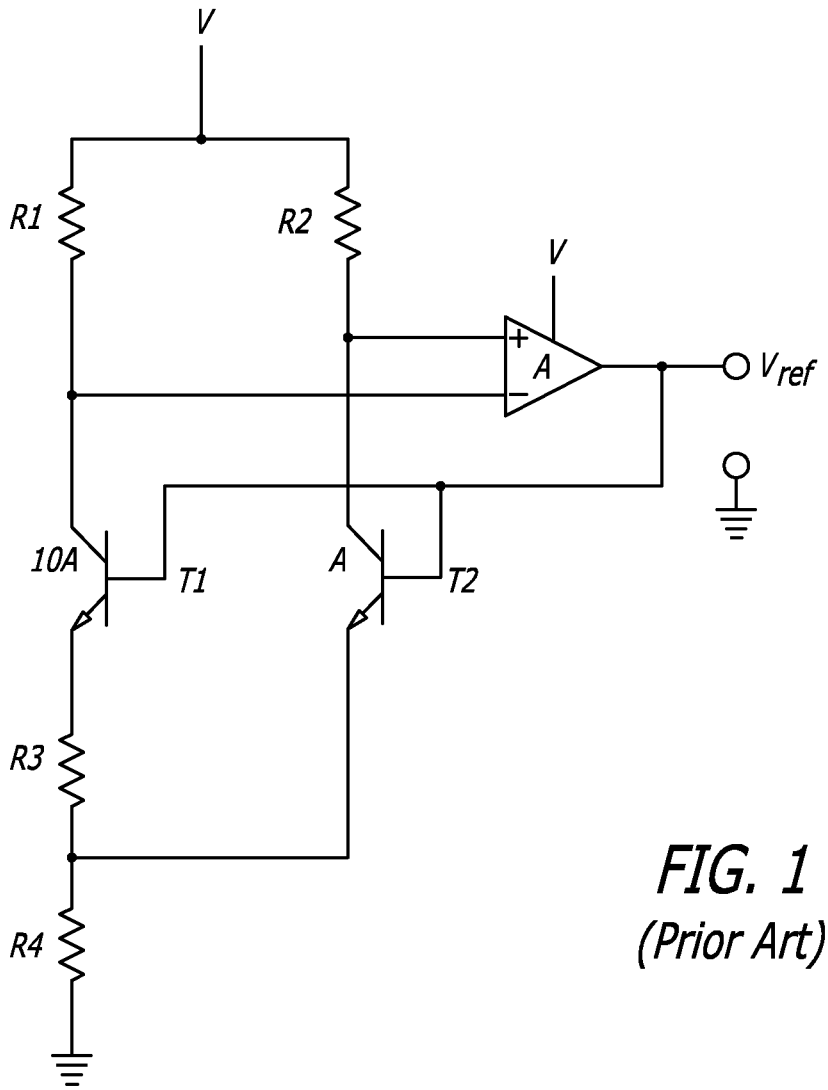
FIG. 1 (Prior Art)
FIG. 1 is a circuit drawing for a prior art Brokaw bandgap reference.
Figures 1, 4:
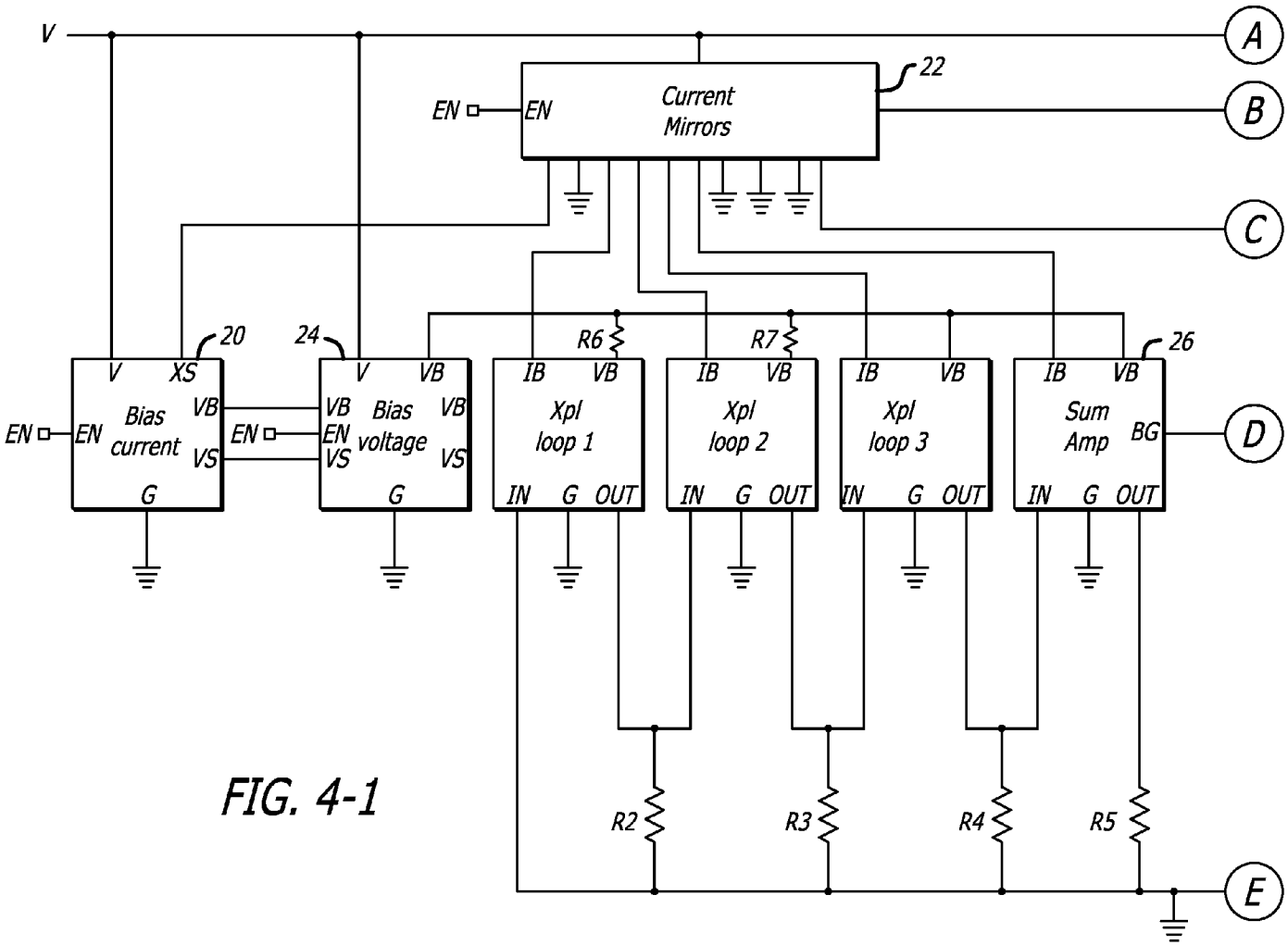
Figures 2, 4:
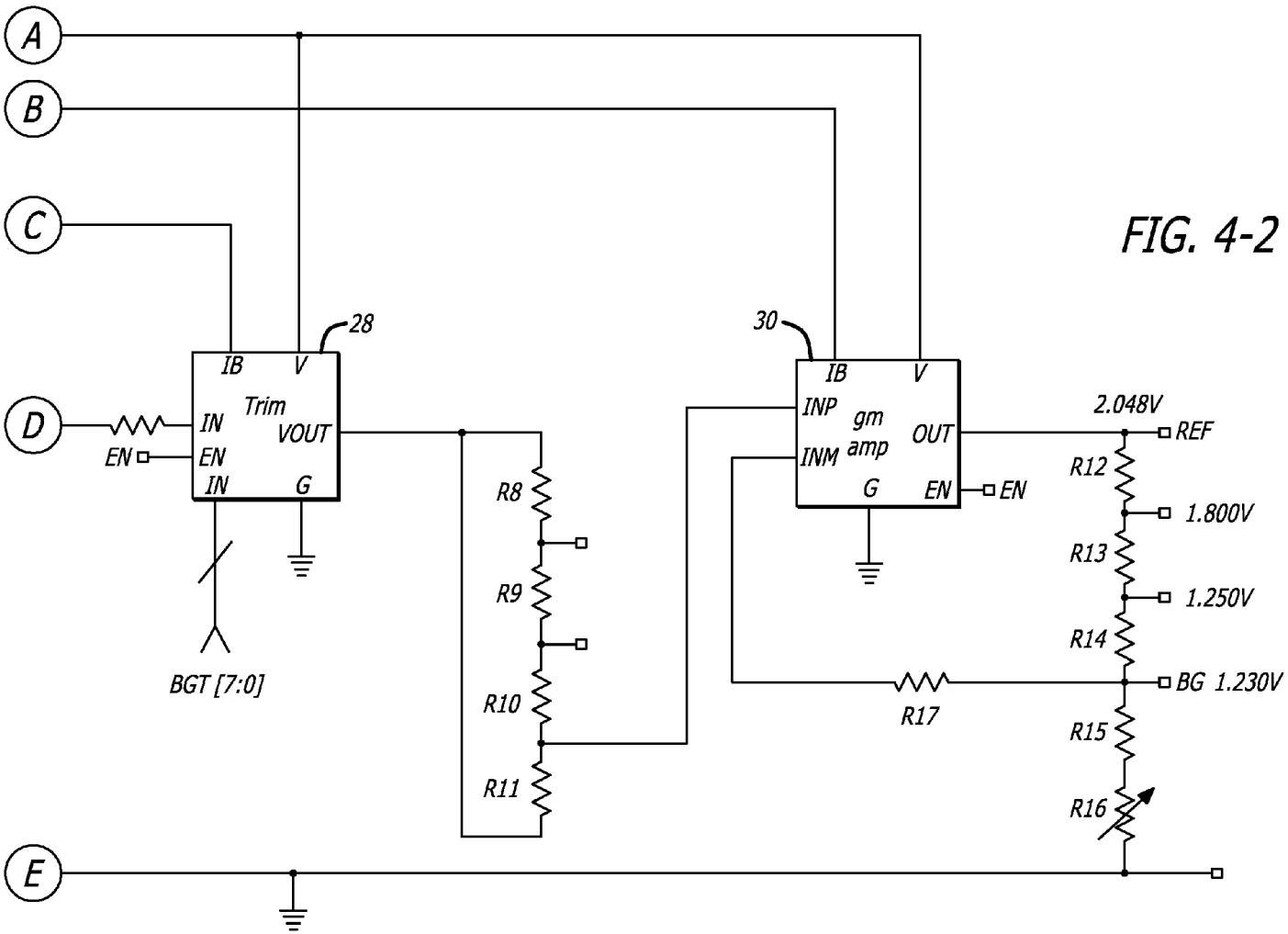

Now referring to FIGS. 4-1 and 4-2, an overall diagram showing a bandgap reference using cascaded Xpl loops in accordance with FIG. 3 may be seen. In these Figures and in other Figures to be described, the signal EN is a conventional enable signal. In the embodiment of FIGS. 4-1 and 4-2, a low noise Bias current generator 20 provides a bias current to low noise buffered current mirrors 22, which in turn provide the bias currents IB to each of the Xpl loops, specifically loop 1, loop 2 and loop 3. Similarly, a bias voltage generator 24 generates the bias voltage VB that is applied to each of the Xpl loops. In that regard, the bias voltage VB is applied through resistors R6 and R7 to Xpl loops 1 and 2, respectively. In particular, note that the emitter of transistor Q1 in loop 1 is at a circuit ground potential, the emitter of transistor QN1 of Xpl loop 2 is at a potential of 2ΔVBE (approximately 200 mV in the exemplary embodiment) and the voltage of the emitter of transistor QN1 in the third Xpl loop is at 4ΔVBE (approximately 400 mV). Thus resistors R6 and R7 are provided in a progression of values to provide a voltage drop of 4ΔVBE and 2ΔVBE, respectively, so that the collector-base voltage of transistors QN2 in all three loops are equal to zero. These resistors are optional, and not shown in the embodiment of FIGS. 6-1, 6-2 and 6-3.

Figure 5:
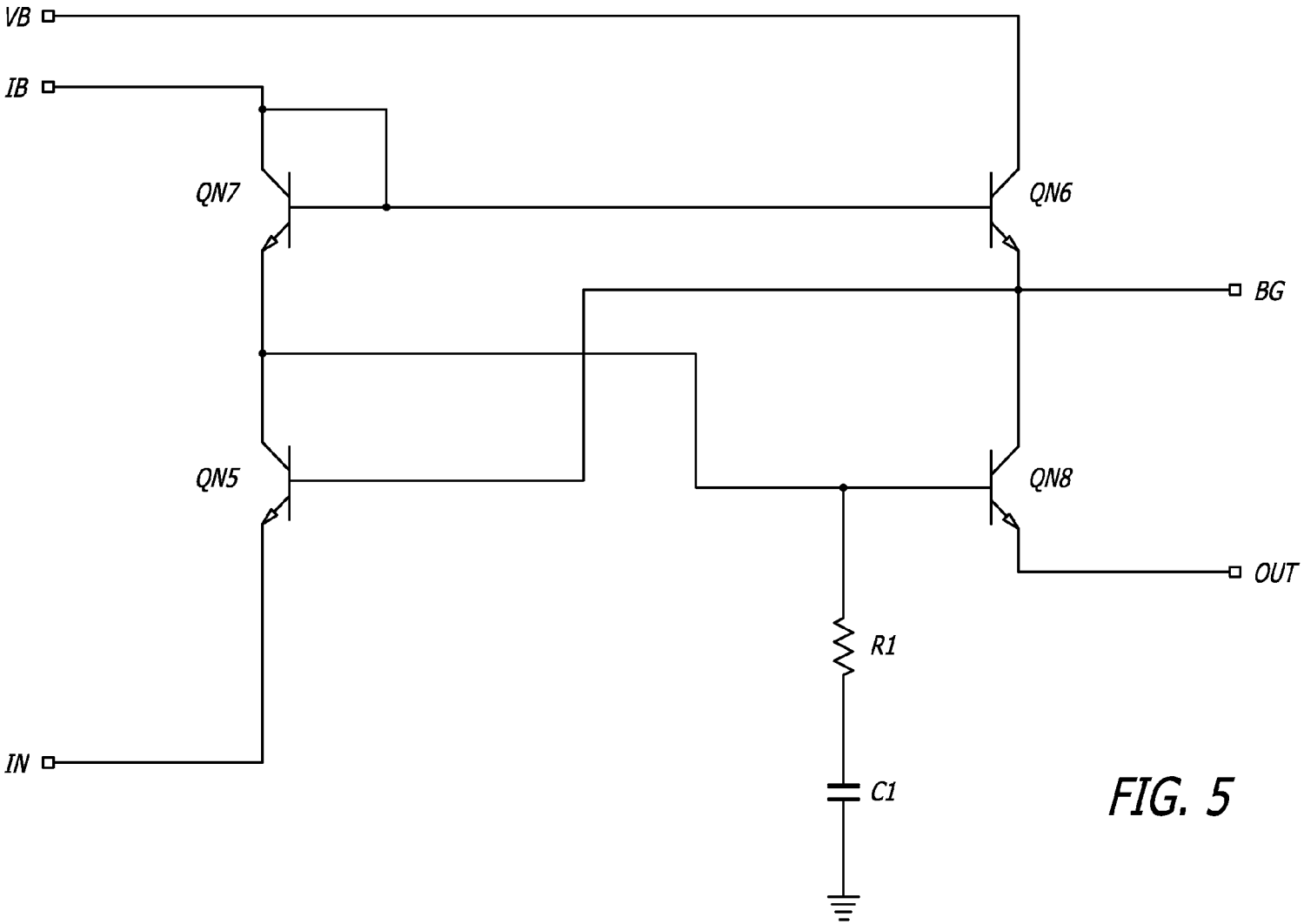
FIG. 5 is a circuit diagram of one embodiment of a summing amplifier for summing a VBE (QN5) with the PTAT output voltage of the cascaded Xpl loops, all in accordance with the embodiment of FIGS. 4-1 and 4-2.

Also connected to the Bias voltage generator 24 and one of the current outputs of the buffered Current mirrors 22 is a Summing amplifier 26. This amplifier is referred to herein as a summing amplifier, as the output thereof is the sum of the 6ΔVBE output of Xpl loop 3 plus the VBE of a bipolar transistor in the summing amplifier itself. The summing amplifier is shown in detail in FIG. 5. This amplifier uses four transistors Q5 through Q8, of the same conductivity type and connected the same as the transistors in one of the Xpl loops. However, in the Summing amplifier of FIG. 5, all transistors preferably have the same emitter area. The output OUT of the amplifier is coupled through resistor R5 to ground, as shown in FIG. 4-1, with the input IN being coupled to resistor R4 and the output OUT of Xpl loop 3, also as shown in FIG. 4-1. As may be seen in FIG. 5, the output BG is 1VBE above the input IN, specifically, the base emitter voltage (VBE) of transistor QN5. The input IN, of course, is the accumulated PTAT voltage 6ΔVBE. In a preferred embodiment each ΔVBE is approximately 100 millivolts, so that at least nominally the sum of the 6ΔVBE (approximately 600 mv) on the input IN plus the base emitter voltage of transistor Q5 (approximately 600 mv) provides the nominal bandgap output voltage of 1.2 volts at BG.

As may be seen in FIGS. 4-1 and 4-2, the nominal bandgap voltage BG output of the Summing amplifier 26 is coupled to a Trim network 28, which may be of conventional design. In the preferred embodiment, the actual Trim network is a Trim network capable of providing both positive and negative trim increments to the bandgap voltage for calibration purposes. Those trim increments, controlled by the 8 bit input BGT[7:0], are PTAT trim voltage increments to make up for ratio deviations in the components of the Xpl loops based on the accumulated PTAT voltage input, as shown. In that regard, assuming that the only significant temperature variations in the bandgap voltage are caused by the negative temperature coefficient of an emitter base (E-B) junction and the positive temperature coefficient ΔVBE of pairs transistors operating with different current densities. Whatever the base emitter voltage is of transistor QN5 of FIG. 5, a substantially temperature insensitive bandgap voltage will be achieved if a PTAT voltage is added thereto to provide a sum equal to the actual bandgap voltage (for silicon −1.23 volts).

While the Trim network used in the preferred embodiment uses digital PTAT trim voltages increments in both positive and negative directions, the Xpl loops could be nominally set to provide a PTAT voltage component somewhat below (or above) the desired value, with the trim network adjusting that PTAT voltage component up (or down) for calibration purposes, or as a further alternative, an analog trim network could be used, again with either positive and negative trimming capabilities, or alternatively, with the ability to either increase or decrease the incremental calibration in a unidirectional manner.

The output of the Trim network 28 (FIG. 4-2), which is the bandgap voltage, goes through a resistor network of resistors R8 though R11 to provide an input to a transconductance operational amplifier 30 (alternatively a regular operational amplifier may be used). The desired bandgap reference voltage (1.23 volts) appears at the top of resistor R15. Therefore the output voltage REF appears at the output of the transconductance operational amplifier. Feedback for the transconductance amplifier is provided by resistor network comprising resistors R12 through R16. Resistors R12 through R14 are of the same value as resistors R8 through R10, respectively, with the nominal combination of resistors R15 and R16 being the same value as resistor R11.

In the exemplary embodiment being explained, the two resistor networks shown in FIG. 4-2 provide a selection of outputs set during fabrication by appropriate masking. In particular, with a bandgap voltage of 1.23 volts out of the trim network 28, the first resistor network will provide that voltage to the positive input to the transconductance operational amplifier 30. The negative input through resistor R17 is taken from the node between resistors R14 and R15. The transconductance operational amplifier provides an output REF which provides the current through resistors R12, R13 and R14. More importantly, through resistors R12 and R16 to provide the negative feedback voltage equal to the bandgap voltage provided to the positive transconductance amplifier input. In the exemplary embodiment, resistors R12 through R16 are selected such that with the configuration shown in FIG. 4-2, the feedback of 1.23 volts provides an output voltage REF of 2.048 volts. If, on the other hand, resistors R8 and R12 are effectively shorted out during fabrication (by masking or otherwise), the transconductance amplifier 30 will readjust the output REF to again provide a feedback of 1.23 volts, in the exemplary embodiment readjusting the output REF to 1.8 volts. Shorting out resistors R8, R9, R12 and R13 in the exemplary embodiment provides an output of 1.25 volts. And finally, shorting out resistors R8 through R10 and R12 through R14 will provide the basic bandgap voltage output of 1.23 volts. Resistor R16 is a variable resistor that acts as the gain trim. In that regard, the resistor network R8 through R11 is provided to adjust the resistance coupled to the positive input of the transconductance amplifier 30 to match the resistance to the negative input of the transconductance amplifier from resistor network R12 through R16.

As an alternative, rather than use a variable resistor (R16) in the output resistor network, after the PTAT voltage component in the output of summing amplifier 26 (FIG. 4-1) has been trimmed, one can use a separate additional trim circuit (as part of the Trim block 28—FIG. 4-2) to add (or subtract) a temperature insensitive voltage component to what would have been the output of the Trim block 28. In one embodiment, these trims are done by providing a voltage component to the output of the summing amplifier 26 by pushing a current into one end of a series resistor and drawing an equal current out of the other end of the series resistor. As before these trims may be preferably bidirectional digital trims, but could be unidirectional or analog trims.

Referring again to FIG. 4-2, the output REF may be increased above 2.048 volts to even higher voltages by simply increasing the total resistances of resistors R12 through R14 and R8 through R10 relative to the sum of resistors R15 and R16. However, doing so, at least by very much, has the disadvantage of simply multiplying (gaining up) the noise on the 1.23 volt bandgap voltage generated. Instead, it is more desirable to create a bandgap reference that generates two times the bandgap, specifically 2.46 volts, using the present invention. Such a circuit is shown in FIGS. 6-1, 6-2 and 6-3.

Figures 1, 6:
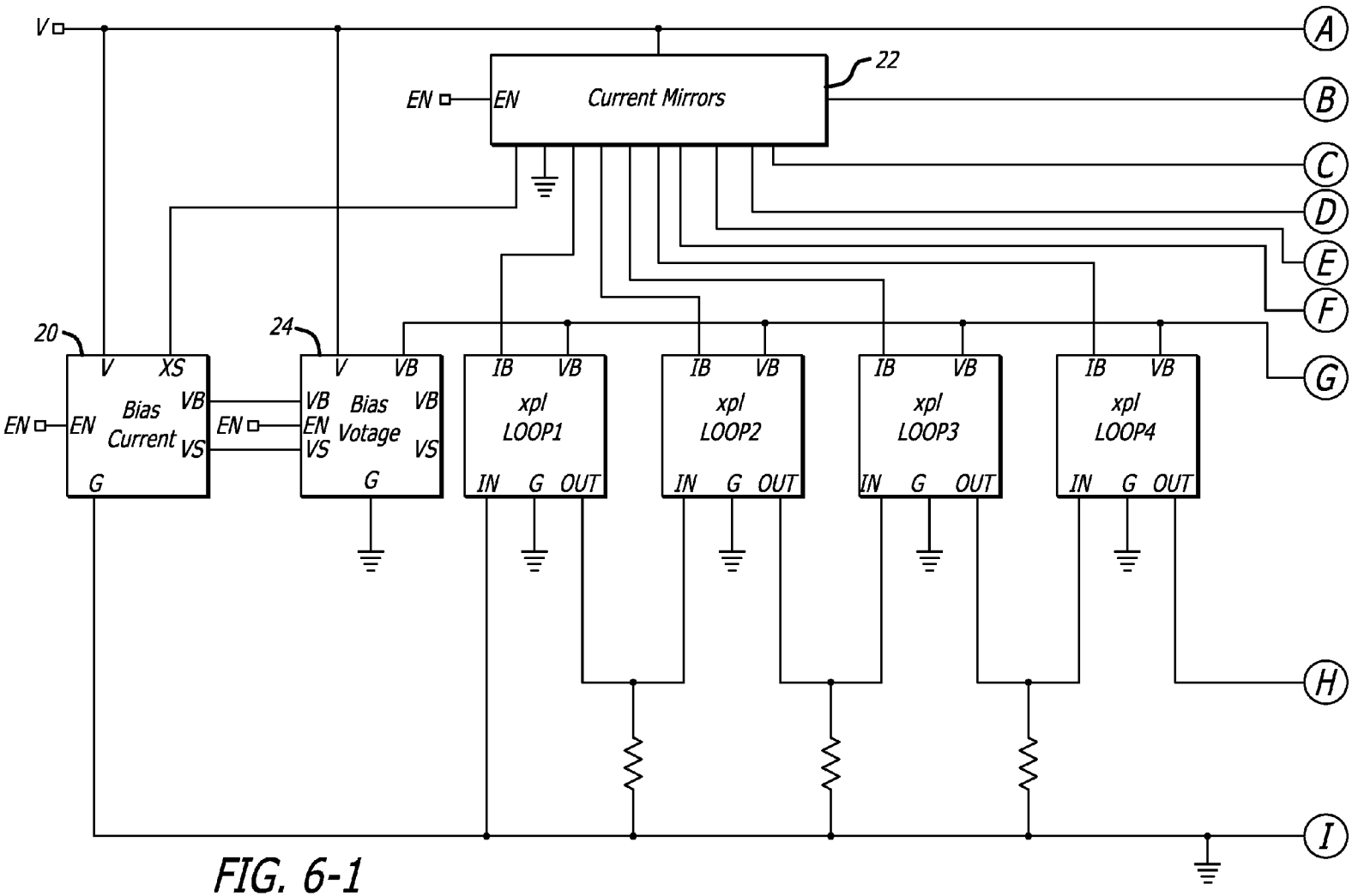
Figures 2, 6:
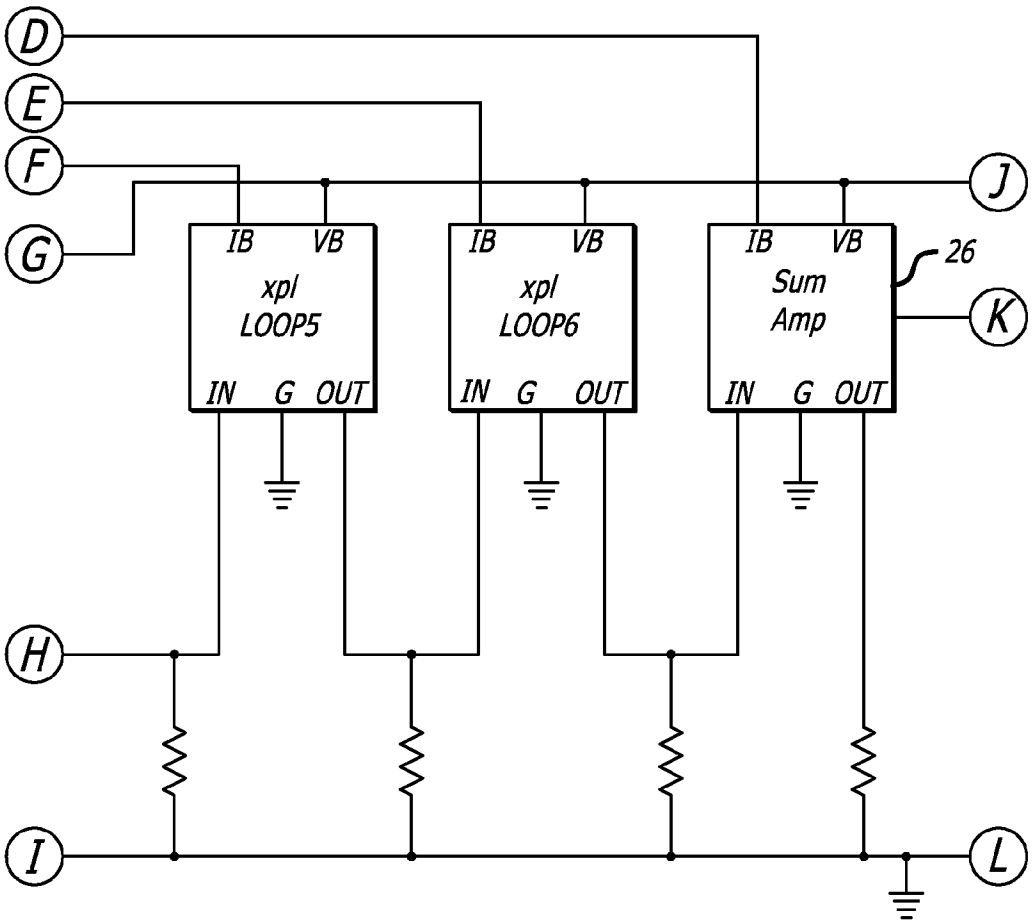
Figures 3, 6:
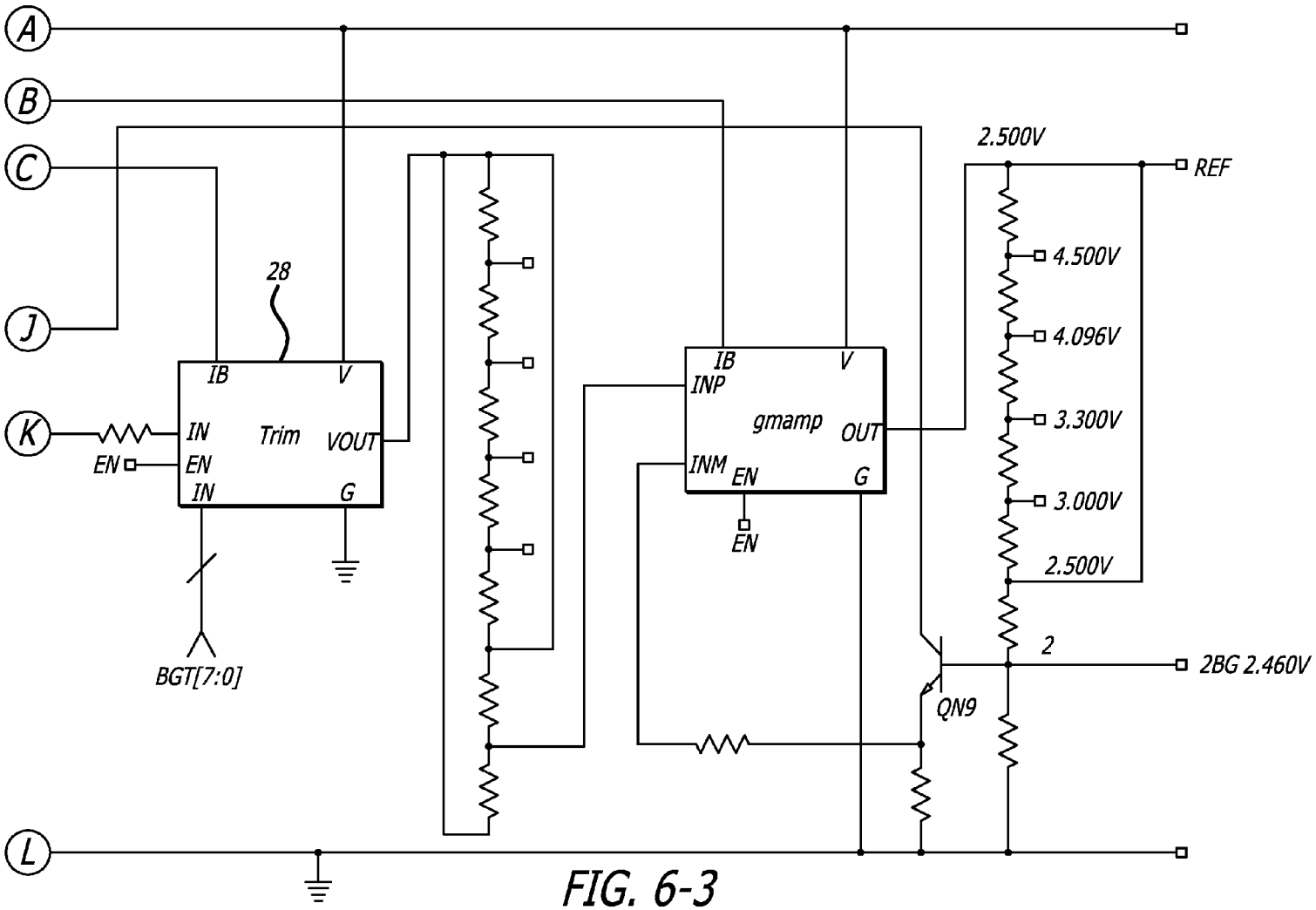
Figures 1, 7:
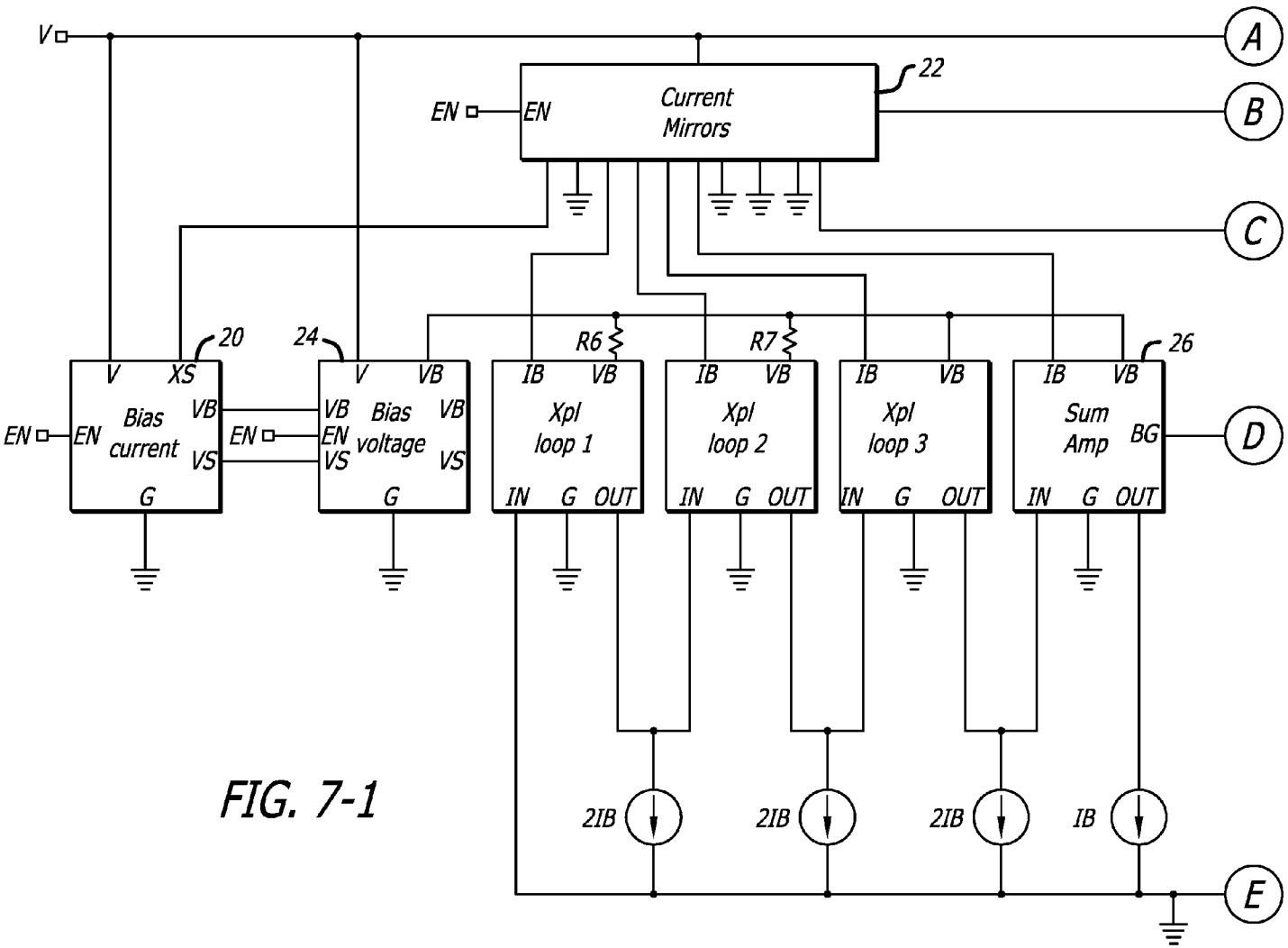
Figures 2, 7:
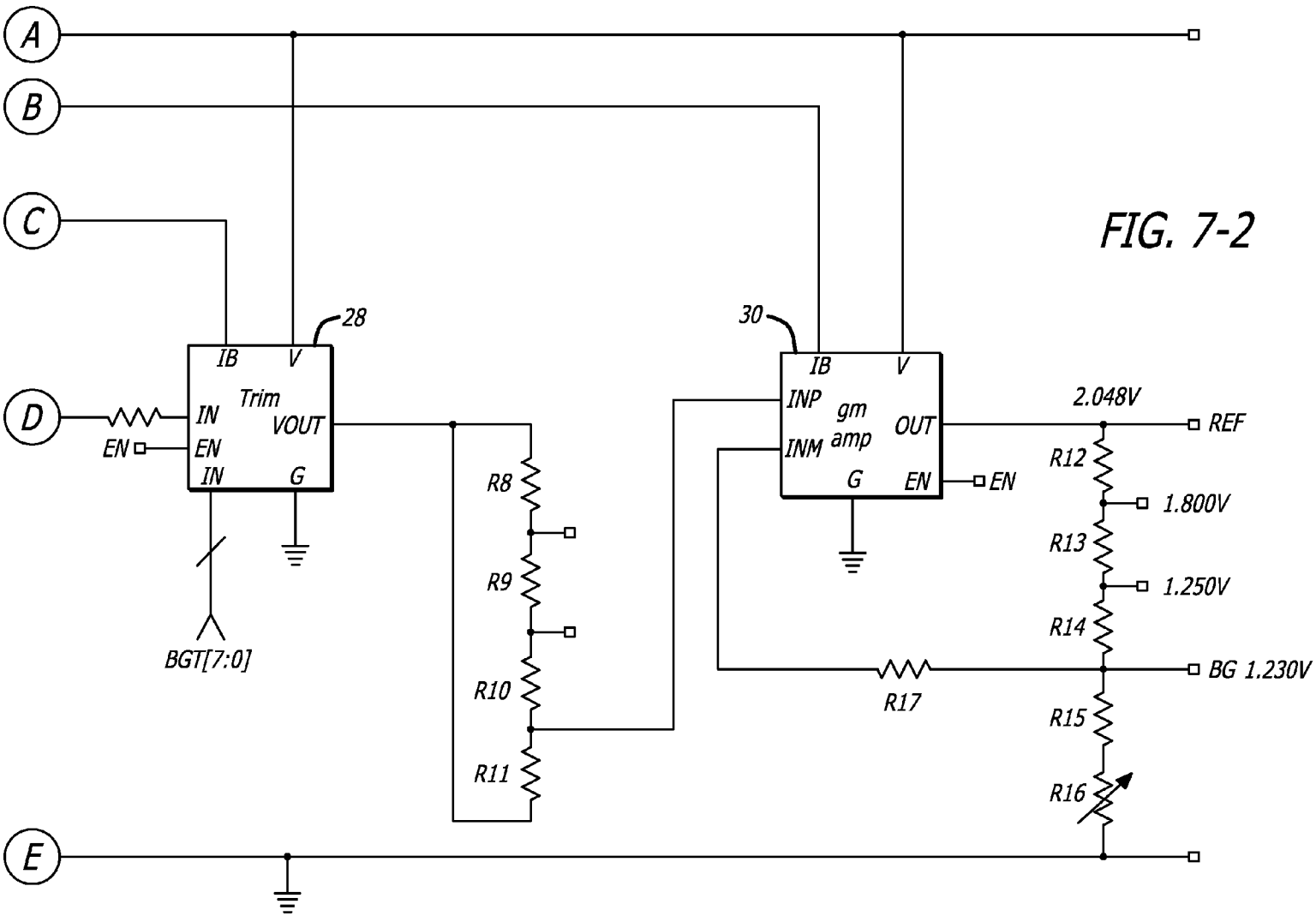
Figures 1, 8:
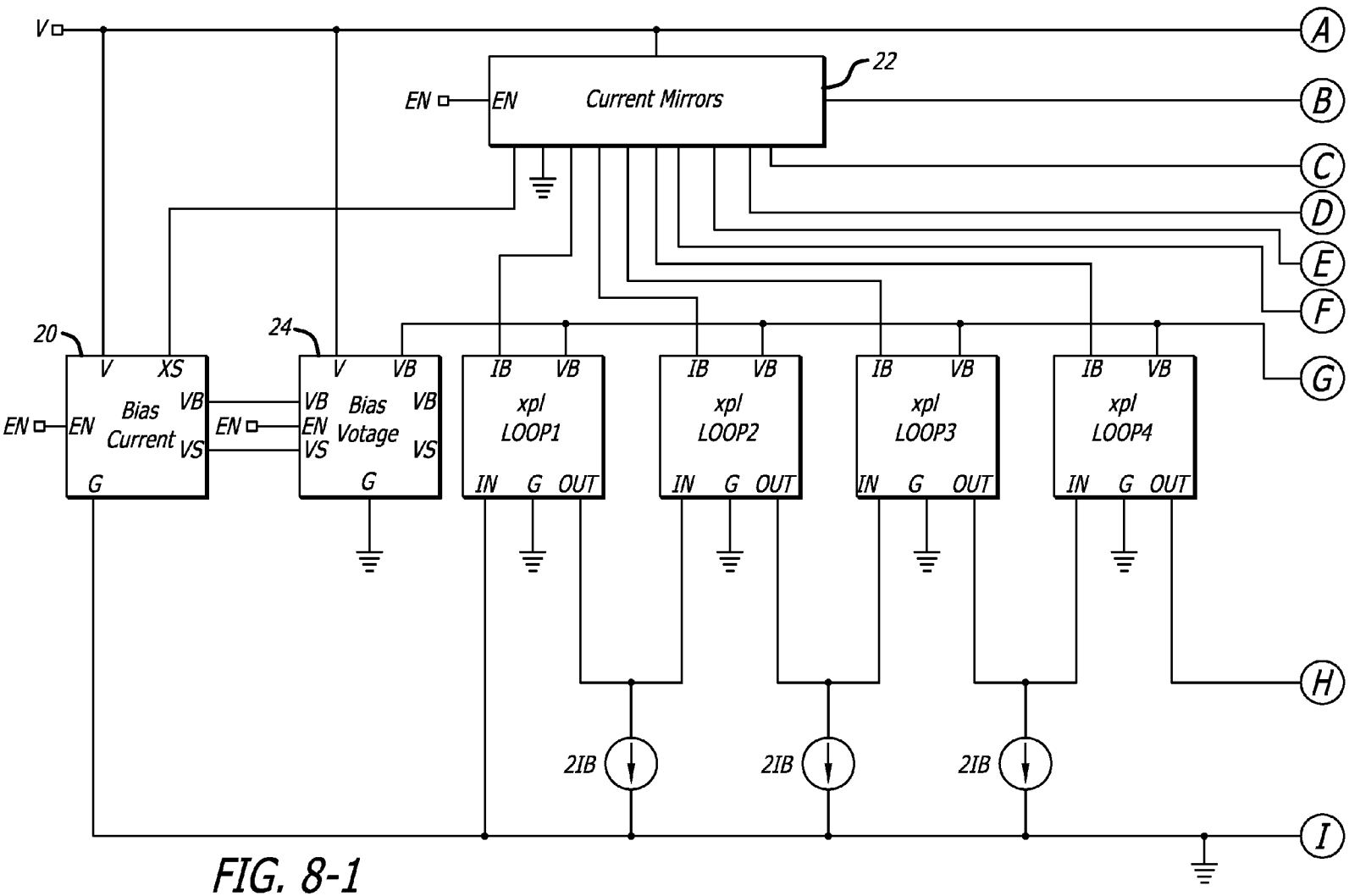
Figures 2, 8:
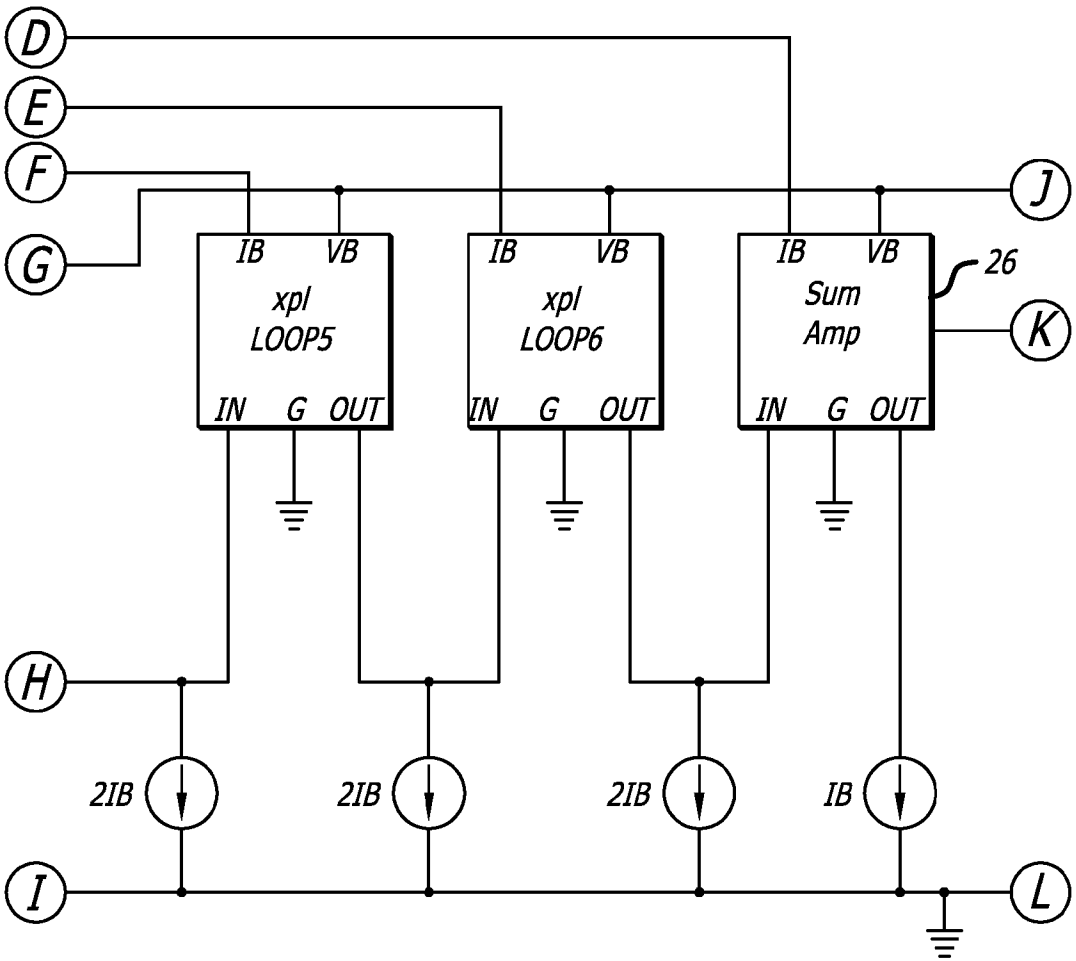
Figures 3, 8:
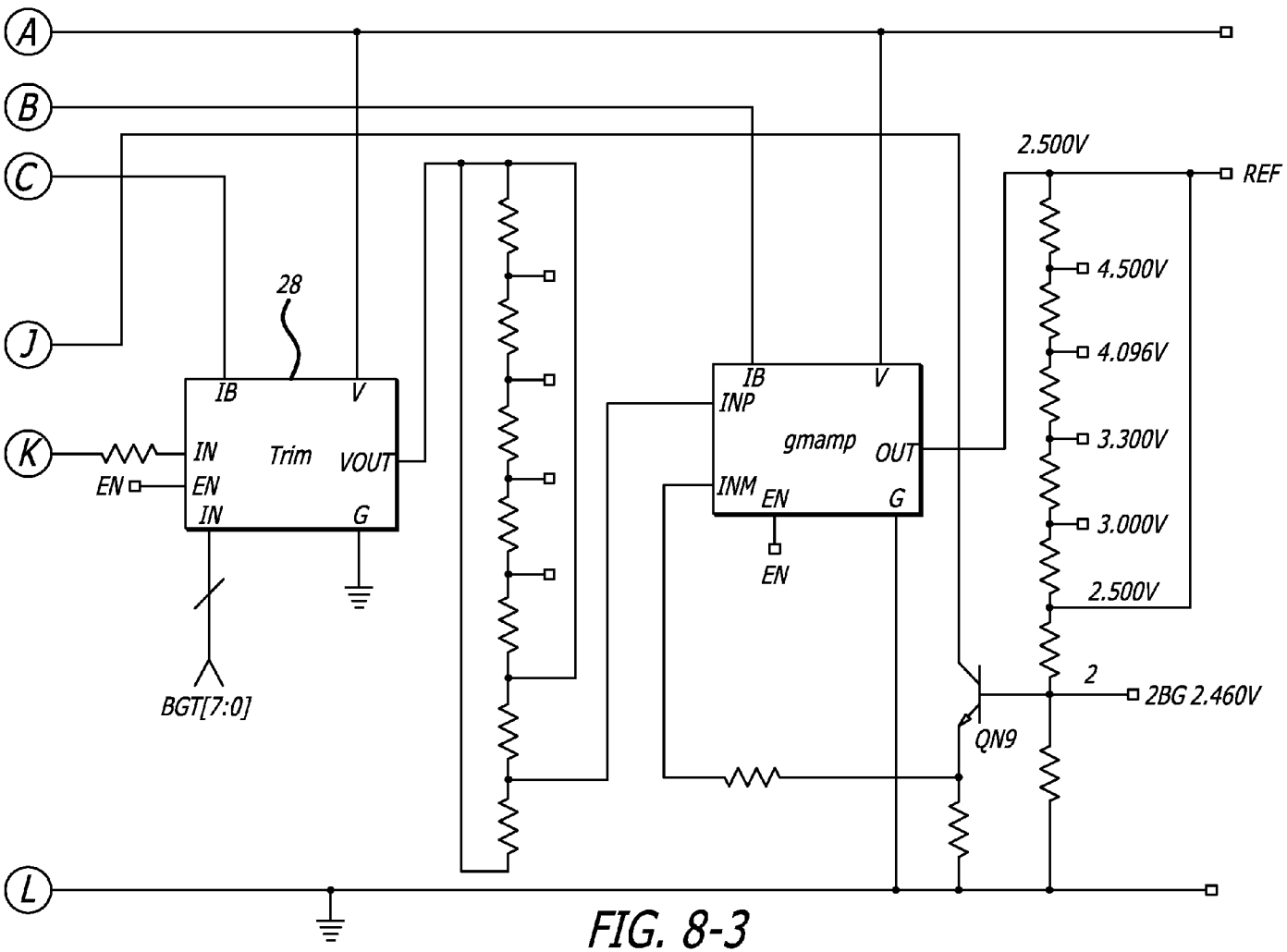

In the circuit of FIG. 6 (FIGS. 6-1, 6-2 and 6-3), a low noise Bias current generator 20 and low noise Voltage bias generator 24, which may be identical to those used in FIG. 4-1, together with the buffered Current mirrors 22 provide the required current and voltage biases to the six Xpl loops used. This provides a total of 12ΔVBE output to the Summing amplifier 26, which again may be the same as that used in the embodiment of FIGS. 4-1 and 4-2. In that regard, note that Summing amplifier 26 adds 1VBE to the total PTAT voltage component, to which another VBE must be added to obtain a voltage equal to twice the bandgap voltage. To achieve this, another transistor might be added to the Summing amplifier 26 so that 2VBE is added to the 12ΔVBE of the six Xpl loops. This is undesirable as it adds to the minimum power supply voltage required to provide the headroom required to operate the entire circuit. Accordingly, as a preferred alternative, transistor QN9 (FIG. 6-3) is added. The second VBE will be the base emitter voltage of transistor QN9. Since the transconductance amplifier is effectively an operational amplifier, its output will seek a level such that its negative input is equal to its positive input of approximately a PTAT voltage of 1.2 volts plus approximately 0.6 volt of the negative temperature coefficient term (VBE term added by the summing amplifier 26). Consequently the voltage at node 2 will be will be one VBE higher than the feedback voltage at INM and thus one VBE higher than the positive input to the transconductance amplifier, or approximately 1.2 volts (2VBE) plus approximately 1.2 volts of PTAT voltage for a total voltage of 2.4V (2 bandgap voltages will now be at node 2). In one embodiment, the resistor networks, similar to those of FIG. 4-2, are selected to provide outputs of 5.00 volts, 4.5 volts, 4.096 volts, 3.30 volts, 3.00 volts, 2.5 volts and the twice bandgap voltage (2BG) of 2.46 volts. As before, trimming may be by way of the variable resistor on the output resistor network as shown, or as part of the Trim block as previously explained with respect to FIGS. 4-1 and 4-2.

It should be noted that the embodiments disclosed herein use low noise current sources and a low noise voltage source to bias the Xpl loops. This is, in effect, an embellishment as opposed to a necessity in that because the Xpl loops are substantially immune to noise in their biasing currents, a relatively low noise bandgap reference (compared to the prior art) would still be provided without the use of such low noise current and voltage sources. Similarly, the resistors R1 and capacitors C1 in each Xpl loop are also optional, but are desirable to provide frequency compensation and prevent peaking in the Xpl loop. In a preferred embodiment the low noise bias Current source 20, the Current mirrors 22 and the Bias voltage generator 24, as well as the six Xpl loops of the embodiment of FIGS. 6-1 through 6-3 for the 2BG reference are also used for the 1BG reference of FIGS. 4-1 and 4-2. In that regard, it may be seen in FIG. 4-1 that three of the current mirror outputs are merely coupled to ground for the 1BG reference, whereas in FIG. 6-1 those same three current mirrors are used to bias the three additional Xpl loops for the 2BG reference. Thus the same chip may be used for both references as determined by specific masking during the fabrication process. The key, of course, to the low noise characteristics of the present invention is based primarily on the Xpl loops themselves, each of which is relatively low noise and substantially immune to noise in its biasing current IB. Thus the noise of the cascaded loops is not additive, but rather only accumulates as the square root of the sum of the squares of the noise of each transistor in each of the Xpl loops. While the PTAT output voltage of the first Xpl loop has relatively low noise, the PTAT output voltage of the second cascaded Xpl loop will have twice the PTAT output voltage of the first Xpl loop, but will have a noise of only $\sqrt{2}$ times the noise voltage signal to noise ratio. Therefore the signal to noise ratio (S/N) is improved by $\sqrt{5}$.

In FIG. 4-1, resistors R2 through R5 actually serve as passive current sources (the words "current sources" are used generically herein to include current sinks). Similarly, the corresponding resistors in FIGS. 6-1 and 6-2 serve as passive current sources. As an alternative, active current sources may be used for some or all of these resistors. This is illustrated in FIG. 7-1, and FIGS. 8-1 and 8-2. FIGS. 7-2 and 8-3 are merely repeats of FIGS. 4-2 and 6-3, but are provided for completeness of these illustrations. Use of active current sources is not preferred however, as simulations indicate that active current sources increase noise in the references, and that the head room for the bipolar current source for the first Xpl loop in a cascaded series of Xpl loops may be marginal.

Figure 9:
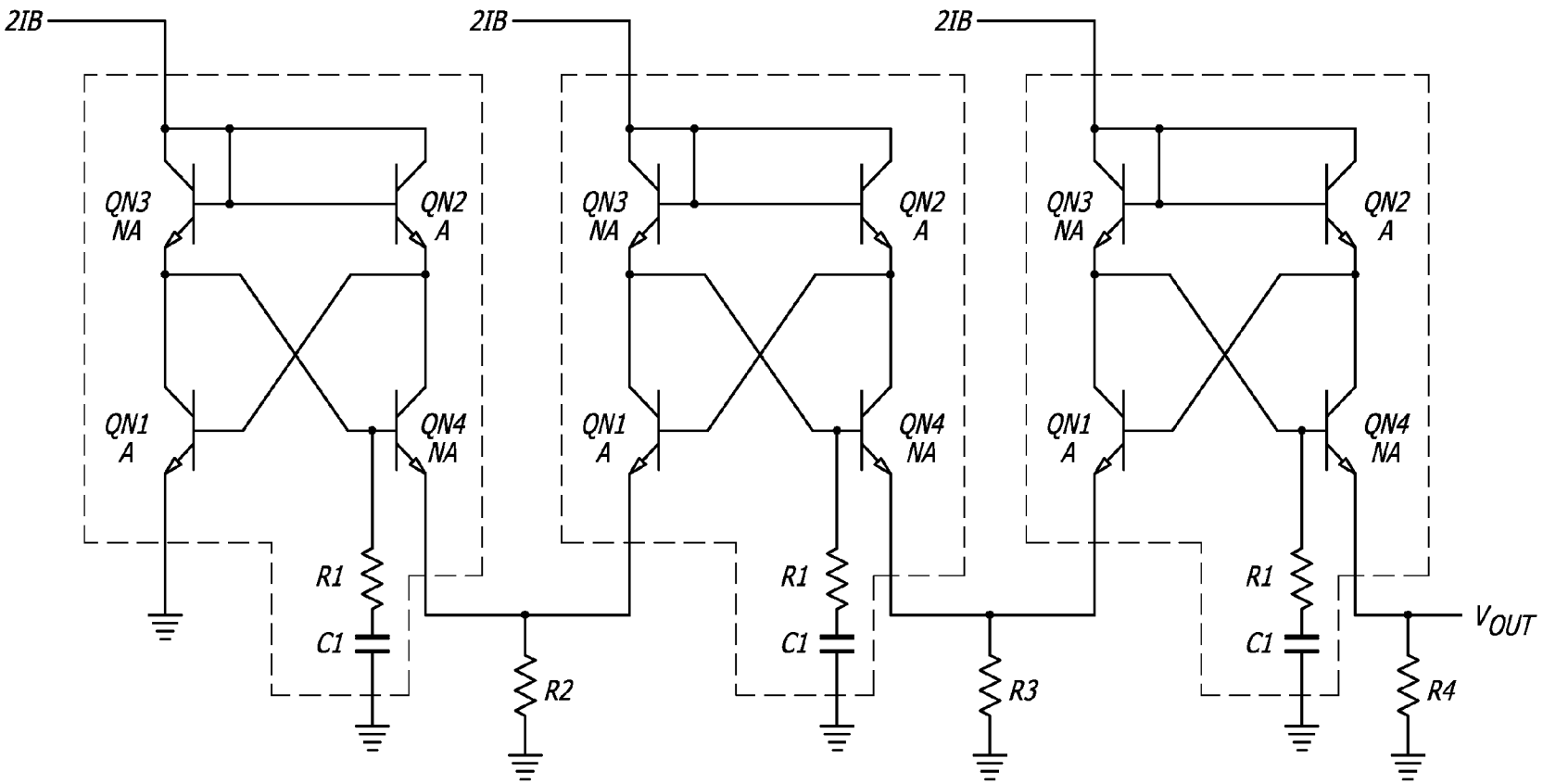
FIG. 9 is a Figure similar to FIG. 3, but using diodes (diode connected transistors for both transistors QN2 and QN3.

In a most general sense, each of the cascaded Xpl loops is comprised of four E-B junctions physically connected in first and second pairs so that bias currents flow through each pair, but electrically cross coupled so that the voltage from an end or output of the first pair of the E-B junctions to an end or output of the second pair of E-B junctions is equal to the voltage drop across a first E-B junction in the first pair of E-B junctions plus the voltage drop across a second E-B junction in the second pair of E-B junctions, minus the sum of the voltage drop across a third E-B junction in the first pair of E-B junctions and the voltage drop across a fourth E-B junction in the second pair of E-B junctions. In the embodiments of cascaded Xpl loops disclosed so far, four transistors have been cross coupled, with one (QN3) being diode connected and another (QN4) being preferably operated with a zero collector base voltage. However, QN2 and QN3 could be diode connected transistors, as shown in FIG. 9. Here, rather than biasing QN2 with a voltage, the bias current to the now two diode connected transistors is increased to provide the bias current IB to each side of the Xpl loops, as shown in FIG. 9. With this change, FIGS. 4-1 and 4-2 become FIGS. 10-1 and 10-2, and FIGS. 6-1 through 6-3 become FIGS. 11-1 through 11-3. In that regard, any mismatch in current sources between the top and bottom of the Xpl circuits will merely accumulate and pass to the ends of the cascaded loops, or at least pass to the side of the first cascaded Xpl loop that is connected to the circuit ground. Note that the biasing of the summing amplifier is preferably not changed so as to be able to better drive the trim circuit coupled thereto.

Figures 1, 10:
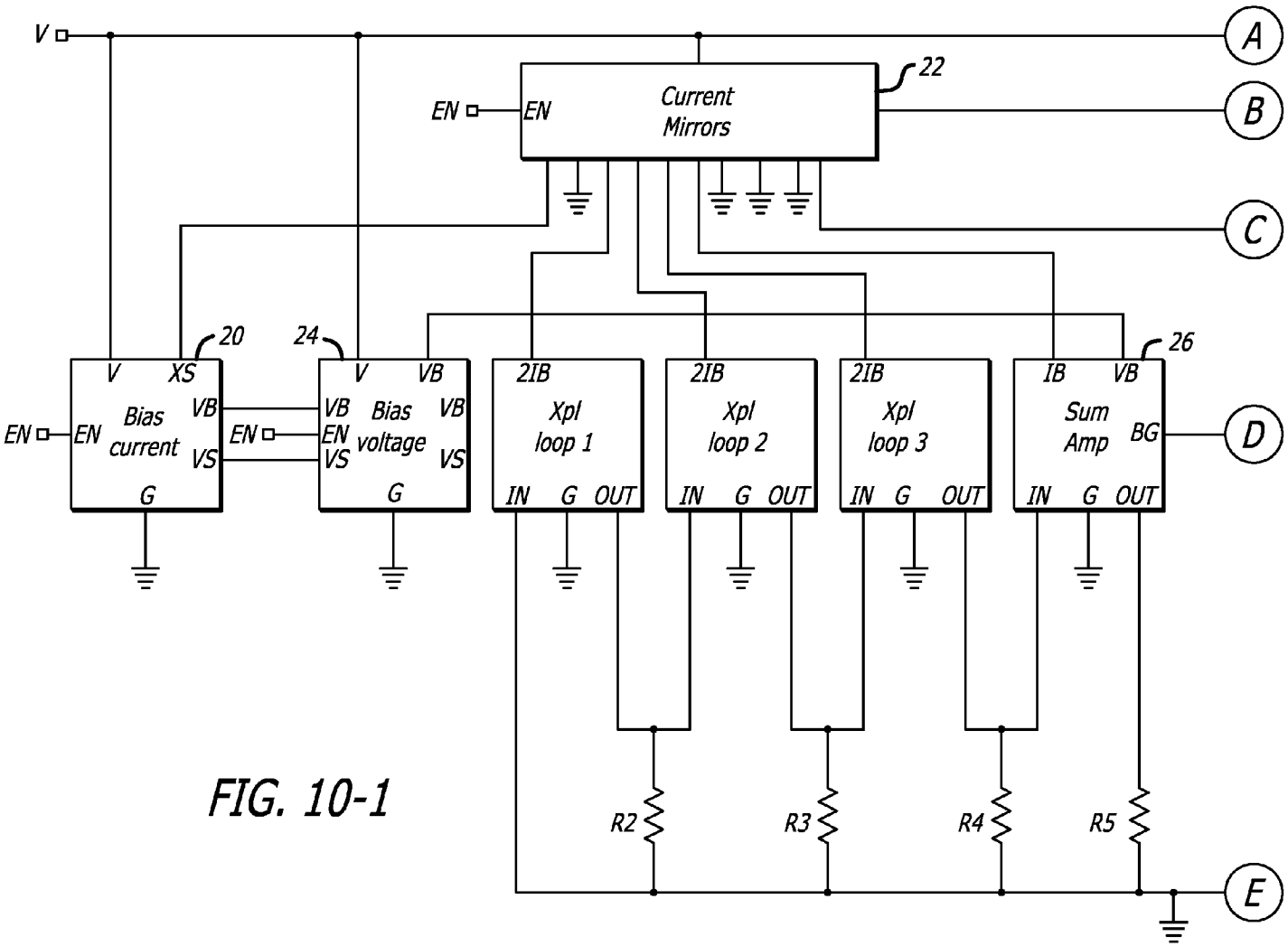
Figures 2, 10:
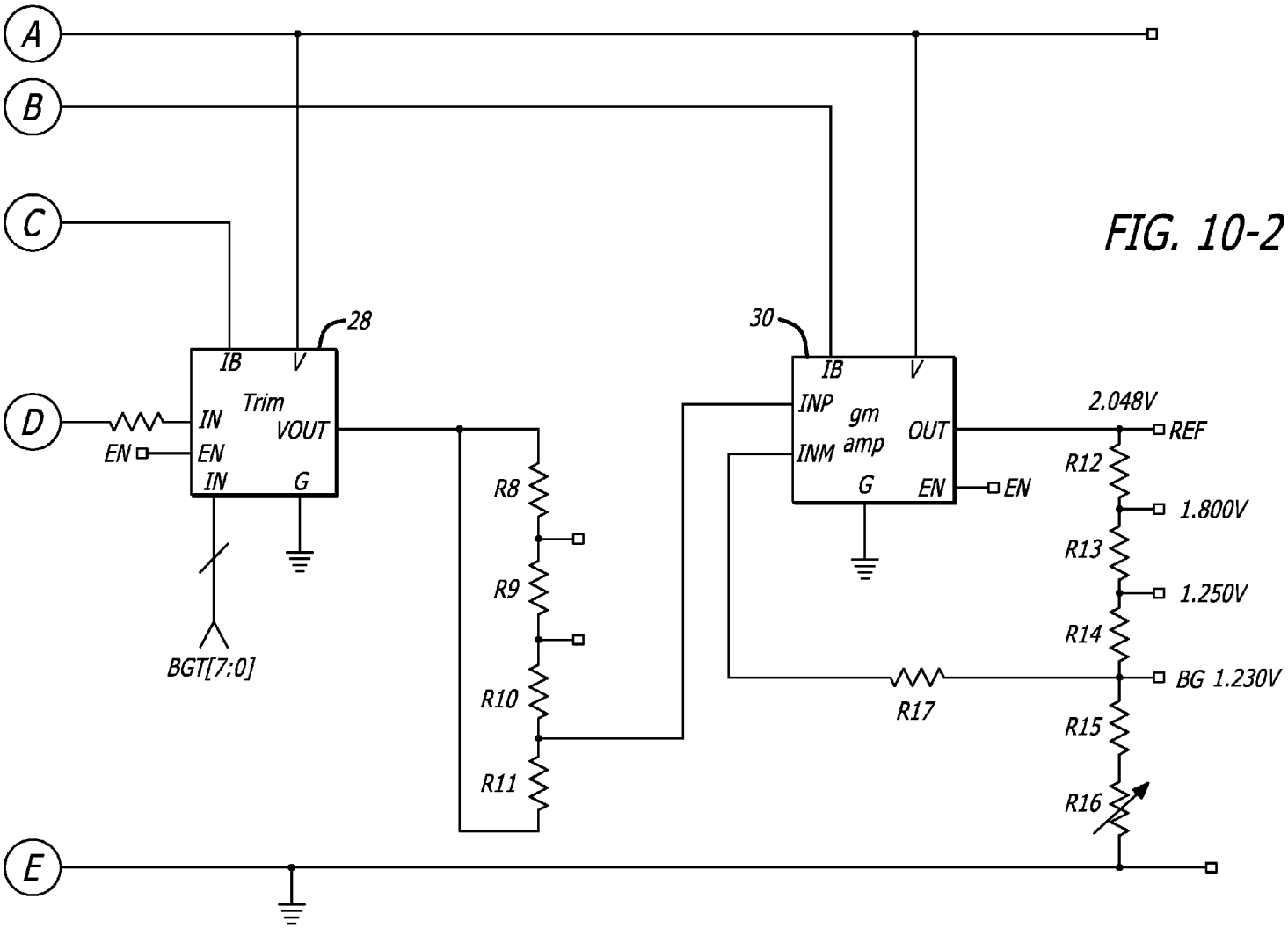
Figures 1, 11:
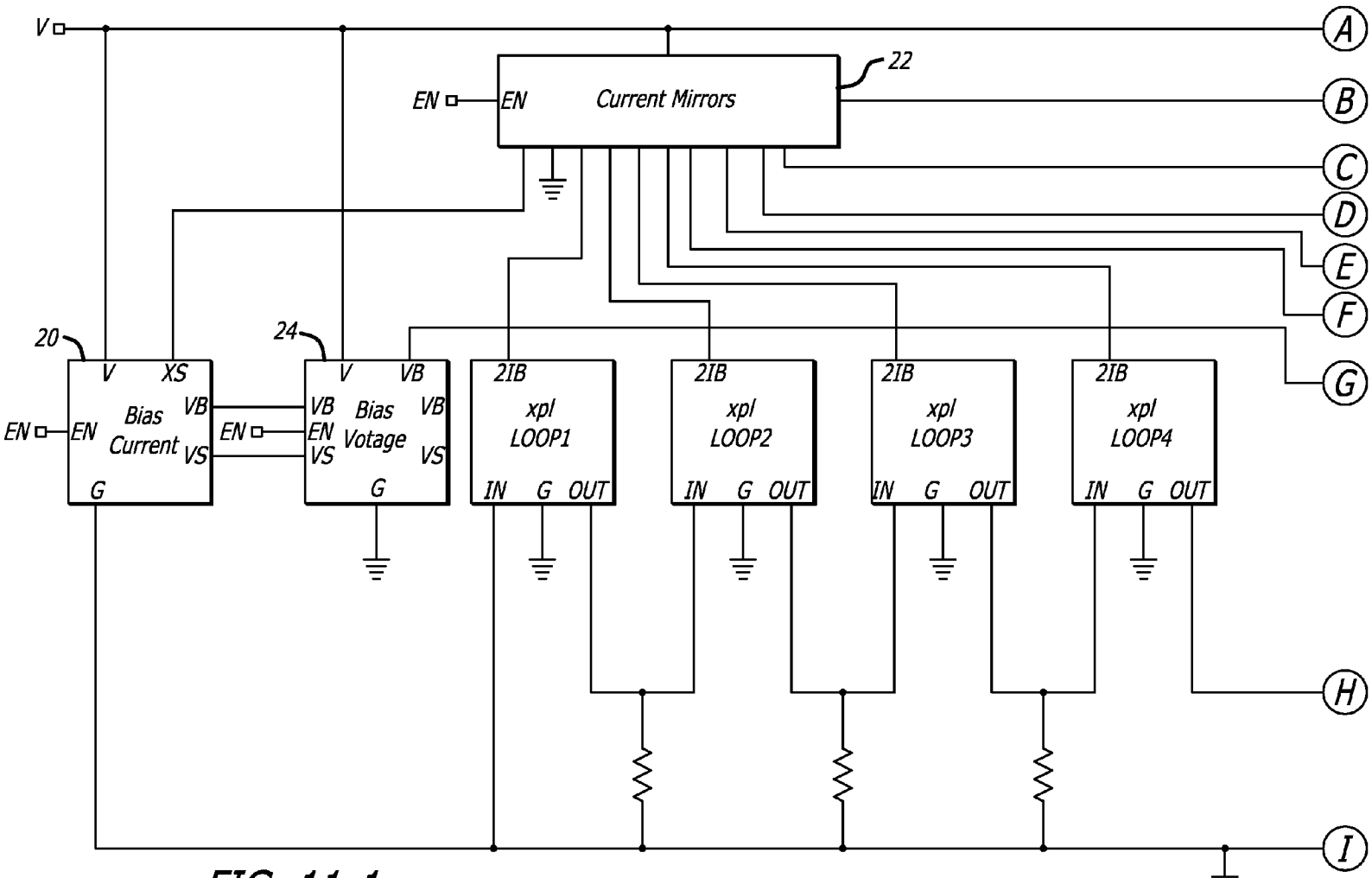
Figures 2, 11:
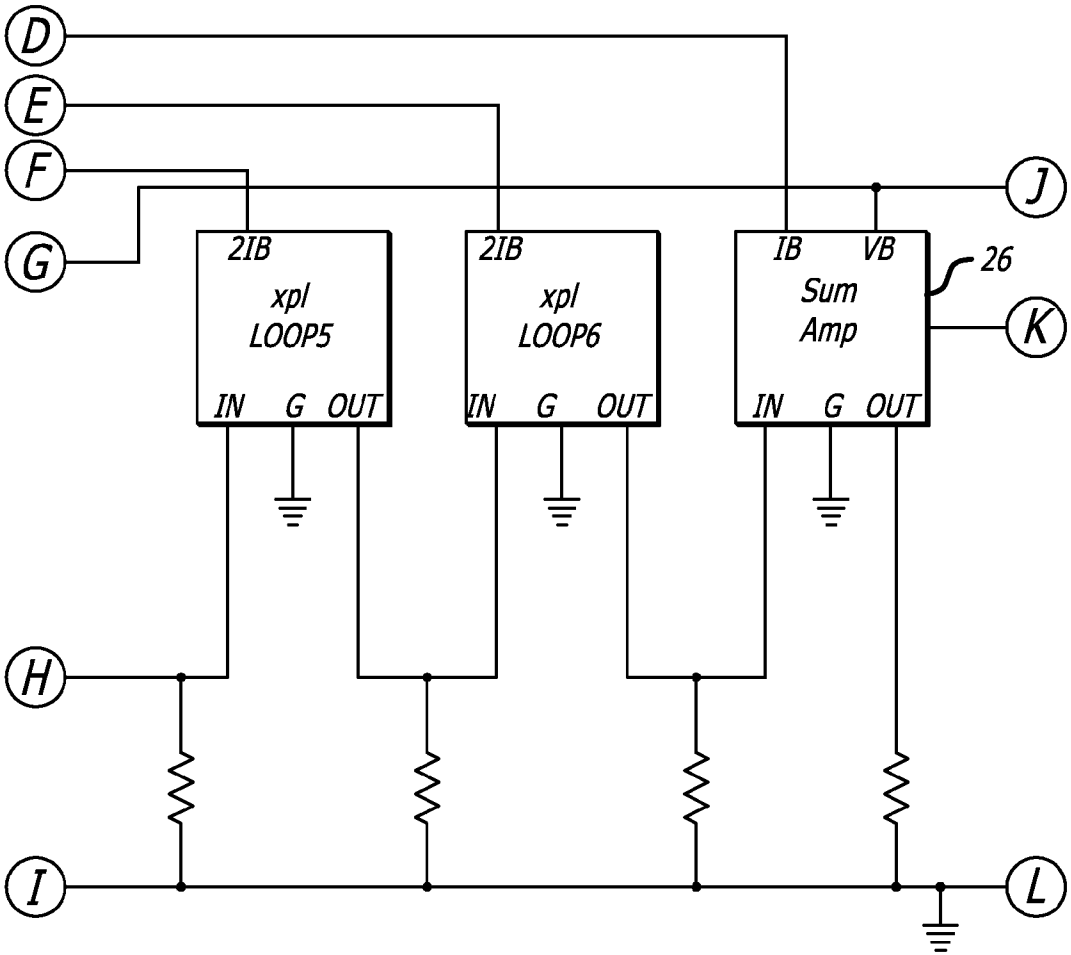
Figures 3, 11:
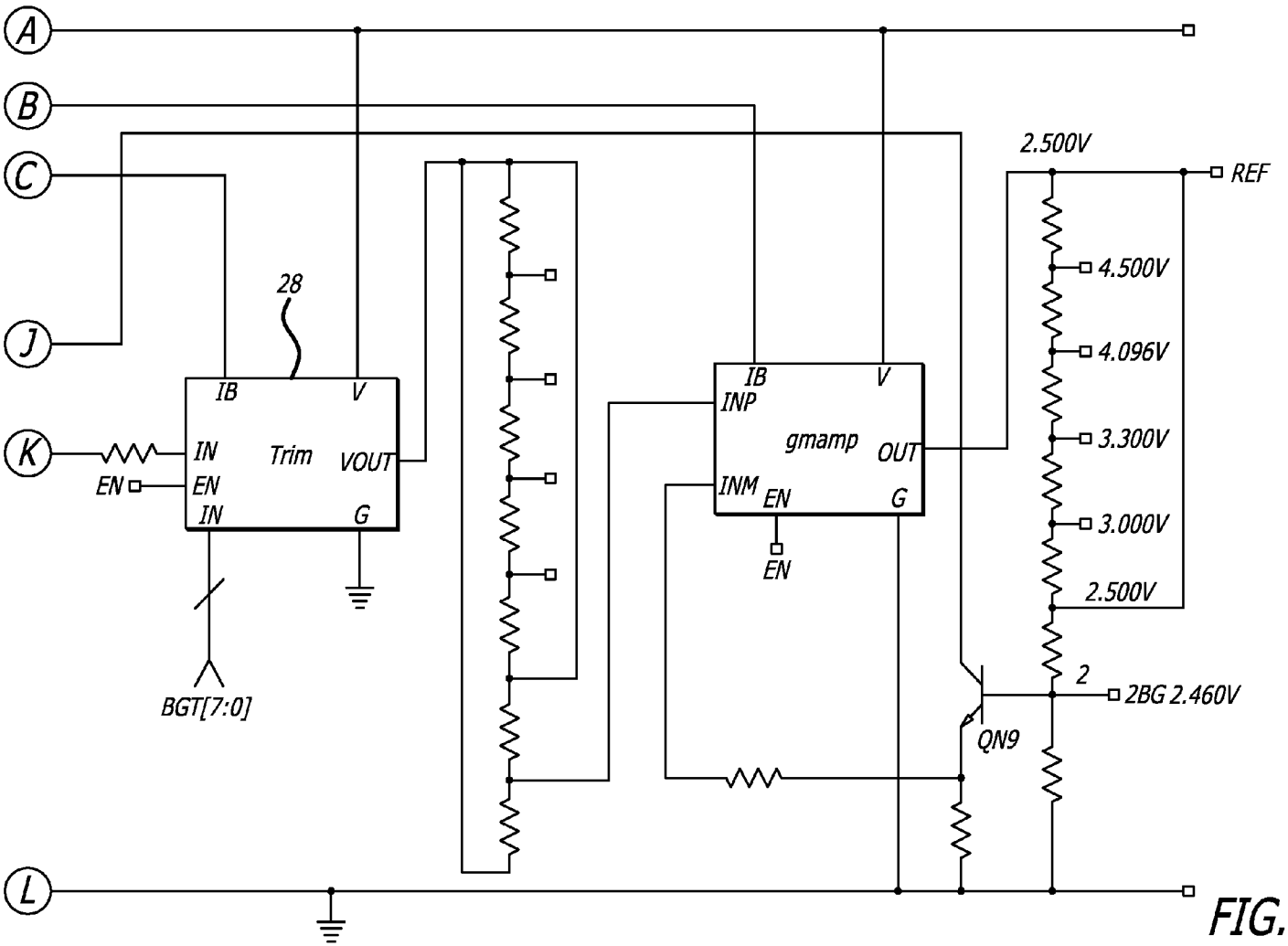

Also in the embodiments described, the summing amplifier is a circuit like an Xpl loop as shown in FIG. 10-1, but simply generates a CTAT voltage (VBE) component by adding the base emitter voltage of transistor QN5 to the total PTAT voltage component of the cascaded Xpl loops. As an alternative, by way of example, the common connection between the emitter of the transistor QN2, the base of transistor QN1 and the collector of transistor QN4 of the last PTAT voltage component generating Xpl loop may be also be used as the sum of the PTAT voltage components and the VBE of transistor QN1 of the last cascaded Xpl loop. Thus in this alternative, the so called summing amplifier may have the E-B junction area ratios as the other Xpl loops. However, the PTAT voltage component generated by such a loop will not be added to the total PTAT voltage output of the cascaded loops, as the common connection merely adds the VBE of transistor QN1 to the total PTAT voltage component of the prior loops, and in the claims to follow, would not be considered to be one of the cascaded PTAT voltage circuits.

Finally, while the present invention has been disclosed and described with respect to basic bandgap references, one may readily include what is referred to as a curvature correction circuit to further flatten the temperature sensitivity of the bandgap voltages generated, if desired. Curvature correction circuitry is well known in the prior art and does not form a part of the present invention. Some embodiments wherein maximum performance is desired will include curvature correction, while other embodiments where minimum die size is the controlling factor, will not include curvature correction. In one embodiment where curvature correction is used, the correction is obtained by varying with temperature, the bias current IB through transistors QN7 and QN5 of the summing amplifier (FIG. 5) for the one BG embodiment of FIGS. 4-1 and 4-2, or varying with temperature, the bias current IB through transistors QN7 and QN5 of the summing amplifier (FIG. 5) and through transistor QN9 (FIG. 6-3) for the two BG embodiment of FIGS. 6-1 through 6-3.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A bandgap voltage reference comprising:

a plurality of cascaded PTAT voltage circuits and a plurality of first current sources, each circuit having first through fourth transistors of the same conductivity type, each having an emitter, a base and a collector, the base of the first transistor being connected to a common connection of the emitter of the second transistor and the collector of the fourth transistor, the base of the fourth transistor being connected to a common connection of the emitter of the third transistor and the collector of the first transistor, the collector of the third transistor being connected to a common connection of the bases of the third and second transistors and to a respective first current source;

circuitry for providing current to the collectors of the second transistors;

the emitter area of the third transistor being larger than the emitter area of the first transistor, and the emitter area of the fourth transistor being larger than the emitter area of the second transistor;

a plurality of second current sources;

the emitter of the first transistor of the first cascaded PTAT voltage circuit being connected to a power supply connection, the emitter of the fourth transistor of the last cascaded PTAT voltage circuit being coupled to the power supply connection through a last of the plurality of the second current sources and to provide a PTAT output voltage;

the emitter of the fourth transistors in all except the last cascaded PTAT voltage circuit being directly connected to the power supply connection through a respective one of the second current sources and to the emitter of the first transistor of the next of the cascaded PTAT voltage circuits.

2. The bandgap reference of claim 1 wherein the second current sources are first resistors.

3. The bandgap reference of claim 2 wherein the first resistors each have a respective resistance selected to tend to equalize the current through the second and fourth transistors of all of the cascaded PTAT voltage circuits.

4. The bandgap reference of claim 1 wherein the second current sources are active current sources.

5. The bandgap reference of claim 1 wherein the circuitry for providing current to the collector of the second transistors is a voltage source.

6. The bandgap reference of claim 5 further comprising a plurality of first resistors, the second transistor of all except the last of the cascaded PTAT voltage circuits being connected to the voltage source through a respective one of the first resistors, the first resistors each having a respective resistance selected to provide a zero collector to base voltage for the second transistors of all of the cascaded PTAT voltage circuits.

7. The bandgap reference of claim 1 wherein the collector of each second transistor is connected to the base of the second transistor and to the collector and the base of the third transistor, whereby the circuitry for providing current to the collector of the second transistors are the first current sources.

8. The bandgap reference of claim 1 wherein the plurality of second current sources are selected so that the current through the second and fourth transistors is approximately the same as the current through the third and first transistors.

9. The bandgap reference of claim 1 further comprising a first amplifier having fifth through eighth transistors of the same conductivity type, each having an emitter, a base and a collector, the base of the fifth transistor being connected to a common connection of the emitter of the sixth transistor and the collector of the eighth transistor, the base of the eighth transistor being connected to a common connection of the emitter of the seventh transistor and the collector of the fifth transistor, the collector of the seventh transistor being connected to a common connection of the bases of the seventh and sixth transistors and to a respective current source, the collector of the sixth transistor being connected to a voltage source, the emitter of the fifth transistor being connected to the emitter of the fourth transistor of the last of the cascaded PTAT voltage circuits, the emitter of the eighth transistor being connected to the power supply connection through a current source, a BG output of the first amplifier being connected to the common connection of the emitter of the sixth transistor, the collector of the eighth transistor and the base of the fifth transistor.

10. The bandgap reference of claim 9 wherein the fifth through eighth transistors are all of the same emitter area.

11. The bandgap reference of claim 9 further comprised of a trim circuit having an input connected to the BG output of the first amplifier for providing a PTAT voltage trim.

12. The bandgap reference of claim 11 further comprised of a operational amplifier and first and second resistor networks, an end of the second resistor network being connected to the power supply connection, a positive input to the operational amplifier being connected to an output of the first amplifier through the first resistor network, an output of the operational amplifier being connected as an output of the bandgap reference and to a negative input of the operational amplifier through the second resistor network and a fourth resistor in series with the negative input of the operational amplifier.

13. The bandgap reference of claim 12 further comprised of a ninth transistor connected to the second resistor network, the ninth transistor having an emitter, a base and a collector and being of the same conductivity type as the first through eighth transistors, the base of the ninth transistor being connected to the second resistor network, the collector of the ninth transistor being coupled to a voltage source and the emitter of the ninth transistor being coupled to the power supply connection through a resistor or current source and to the negative input to the operational amplifier through the fourth resistor.

14. The bandgap reference of claim 12 wherein the transistors are npn transistors and the power supply connection is a circuit ground.

15. The bandgap reference of claim 1 wherein the base of the fourth transistor in each PTAT voltage circuit is coupled to the power supply connection through a respective capacitor.

16. The bandgap reference of claim 1 wherein the base of the fourth transistor in each PTAT voltage circuit is coupled to the power supply connection through a respective series connection of a resistor and a capacitor.

* * * * *